US010105017B2

(12) United States Patent
Clear et al.

(10) Patent No.: US 10,105,017 B2
(45) Date of Patent: Oct. 23, 2018

(54) LINEAR DRAIN SYSTEM

(71) Applicant: Fin Pan, Inc., Hamilton, OH (US)

(72) Inventors: Jason T. Clear, Oxford, OH (US); Ryan D. Schaffer, Hamilton, OH (US)

(73) Assignee: Fin Pan, Inc., Hamilton, OH (US)

( * ) Notice: Subject to any disclaimer, the term of this patent is extended or adjusted under 35 U.S.C. 154(b) by 289 days.

(21) Appl. No.: 14/667,772

(22) Filed: Mar. 25, 2015

(65) Prior Publication Data

US 2016/0281346 A1 Sep. 29, 2016

(51) Int. Cl.

| | |
|---|---|
| ***A47K 3/40*** | (2006.01) |
| ***E03F 5/04*** | (2006.01) |
| ***E04F 15/02*** | (2006.01) |

(52) U.S. Cl.

CPC ..... *A47K 3/40* (2013.01); *A47K 3/405* (2013.01); *E03F 5/0407* (2013.01); *E04F 15/02188* (2013.01)

(58) Field of Classification Search

CPC ..... A47K 3/40; A47K 3/405; E03F 5/0407; E04F 15/02188

USPC ..... 4/613

See application file for complete search history.

(56) References Cited

U.S. PATENT DOCUMENTS

| | | | | |
|---|---|---|---|---|
| 8,505,131 | B2 | 8/2013 | Doolittle et al. | |
| 9,334,638 | B1 * | 5/2016 | Kirby | A47K 3/40 4/613 |
| 2011/0047695 | A1 | 3/2011 | Niedens | |
| 2014/0259371 | A1 | 9/2014 | Schaffer et al. | |

FOREIGN PATENT DOCUMENTS

| | | |
|---|---|---|
| WO | WO/2014/144031 | 9/2014 |

OTHER PUBLICATIONS

Infinity Drain: Site Sizable, infinitydrain.com (2015).

* cited by examiner

*Primary Examiner* — Tuan N Nguyen
(74) *Attorney, Agent, or Firm* — Walters & Wasylyna LLC

(57) ABSTRACT

A linear drain system may include a main body including a first end, a second end longitudinally opposed to the first end, and a top surface, a drain opening formed through the main body, and a drain channel formed in the top surface and extending longitudinally from proximate the first end to proximate the second end and in fluid communication with the drain opening, wherein the drain channel includes a V-shape in cross-section.

18 Claims, 15 Drawing Sheets

LINEAR DRAIN SYSTEM

FIELD

The present disclosure is generally related to drain systems and, more particularly, to a modular, low profile linear drain system for floors.

BACKGROUND

Water drains are used in various applications. One such application is a trench drain. One type of trench drain is a linear floor drain, for example, used in shower floors. Linear floor drains typically include a U-shaped channel depending downwardly from and located under a floor surface. The channel includes generally horizontal sidewalls depending upwardly from and surrounding a drain trough. The drain trough is configured to convey liquid (e.g., water) entering the channel to a drainpipe.

Typically, a trench drain includes a channel depth equal to or greater than a channel width (e.g., the lateral distance between the sidewalls). Disadvantageously, due to the channel depth of traditional trench drains, installation of a linear floor drain may be limited. For example, the floor must be deep enough to accommodate the channel depth; otherwise, a linear floor drain may not be an available drain option.

One solution to this disadvantage is to lower the subfloor below the drain floor surface in order to increase the available depth needed for the linear floor drain. Disadvantageously, this solution requires substantial modification to the floor, for example, requiring cutting out and splicing portions of the underlying floor joists.

Another solution to this disadvantage is to raise the drain floor surface above the surrounding floor surface in order to increase the available depth needed for the linear floor drain. Disadvantageously, this solution creates a physical step up to the drain floor surface. Such a step up can create a barrier making it difficult, particularly for a disabled person, to access the drain floor surface. For example, the barrier can block entry to and exit from a shower.

Accordingly, those skilled in the art continue with research and development efforts in the field of floor drain systems.

SUMMARY

In one embodiment, the disclosed linear drain system may include a main body including a first end, a second end longitudinally opposed to the first end, and a top surface, a drain opening formed through the main body, and a drain channel formed in the top surface and extending longitudinally from proximate the first end to proximate the second end and in fluid communication with the drain opening, wherein the drain channel includes a V-shape in cross-section.

In another embodiment, the disclosed floor may include a subfloor, a drain extending at least partially through the subfloor, a drain system including a main body coupled to the subfloor, wherein the main body includes a first end, a second end longitudinally opposed to the first end, and a top surface, a drain opening formed through the main body, wherein the drain is coupled to the main body within the drain opening, and a drain channel formed in the top surface and extending longitudinally from proximate the first end to proximate the second end and in fluid communication with the drain opening, wherein the drain channel includes a V-shape in cross-section, an underlayment disposed over the subfloor and extending to the main body, and a floor covering disposed over the underlayment and extending to the drain channel.

In yet another embodiment, disclosed is a method for manufacturing a main body of a linear drain system, the method may include the steps of (1) forming a hub, wherein the hub includes a V-shaped hub drain channel and a drain opening at least partially intersecting the hub drain channel, (2) forming a pair of end caps configured to connect to the hub, wherein each end cap includes a V-shaped end cap drain channel, and (3) forming an extension configured to connect between the hub and one of the pair of end caps, wherein the extension includes a V-shaped extension drain channel.

In one embodiment, forming the hub may include molding a base material to form the hub drain channel and the drain opening. In another embodiment, forming the hub may include extruding a base material to form the hub drain channel and machining the drain opening through the hub.

Other embodiments of the disclosed systems and methods will become apparent from the following detailed description, the accompanying drawings and the appended claims.

DETAILED DESCRIPTION

Figure 1:
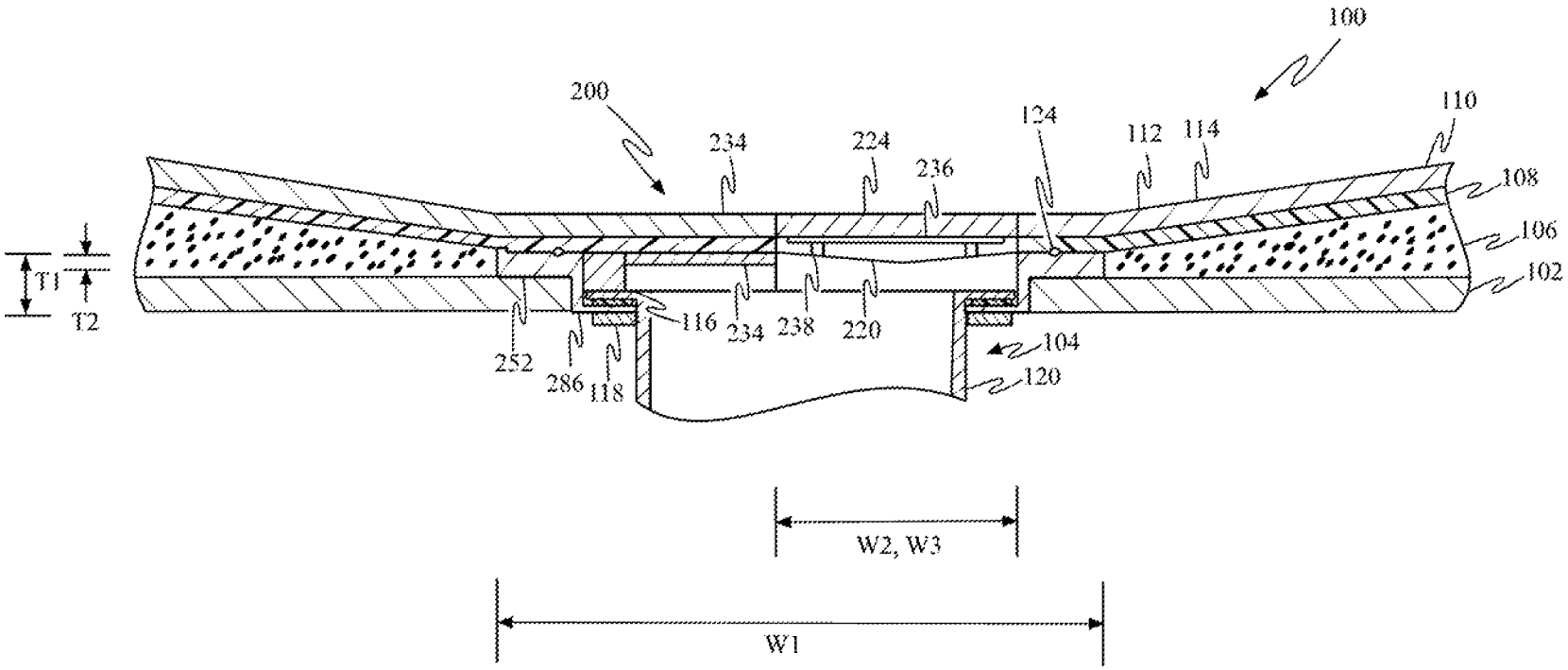
FIG. 1 is a schematic elevational view, in section, of one embodiment of the disclosed floor with liner drain system.

The following detailed description refers to the accompanying drawings, which illustrate specific embodiments of the disclosure. Other embodiments having different structures and operations do not depart from the scope of the present disclosure. Like reference numerals may refer to the same element or component in the different drawings.

Referring to FIG. 1, disclosed is one embodiment of floor, generally designated 100. Floor 100 may be any floor construction having a surface (e.g., drain floor surface 112) where a liquid (e.g., water) may collect to be drained. As non-limiting examples, floor 100 may include, but is not limited to, a shower floor, a bathtub floor, pool deck floor (e.g., around a perimeter of a pool), a patio floor, a basement floor and the like.

As one non-limiting example, floor 100 (e.g., a shower floor, a bathtub floor, etc.) may include subfloor 102. As one example, subfloor 102 may include, but is not limited to a three-quarter inch plywood subfloor. Drain 104 may at least partially extend through subfloor 102, for example, through an opening cut or otherwise formed through subfloor 102. As one non-limiting example, drain 104 may include a standard diameter drainpipe suitable to drain water from floor 100 (e.g., two-inch, etc.) As one general, non-limiting example, drain 104 may include a plastic drainpipe. As specific, non-limiting examples, drain 104 may include a drainpipe made from polyvinyl chloride ("PVC"), acrylonitrile butadiene styrene ("ABS"), cross-linked polyethylene ("PEX") and the like. As another general, non-limiting example, drain 104 may include a metal drainpipe. As specific, non-limiting examples, drain 104 may include a drainpipe made from cast iron, copper, galvanized steel and the like.

Underlayment 106 may be laid over subfloor 102. As examples, underlayment 106 may include, but is not limited to, concrete, mortar or screed. Underlayment 106 may include a slope (e.g., approximately a two-degree slope) directed toward drain 104.

Waterproofing membrane 108 may be laid over underlayment 106. As examples, waterproofing membrane 108 may include, but is not limited to, a waterproof fabric sheet (e.g., PVC or chlorinated polyethylene ("CPE")) adhered to underlayment 106 (e.g., by glue or thinset cement) or a waterproof coating painted on underlayment 106.

While the example of FIG. 1 illustrates a single waterproofing membrane 108 laid over underlayment 106, those skilled in the art will recognize that additional waterproofing membranes (not explicitly illustrated) at additional and/or alternative locations may be used to construct floor 100. As one example, waterproofing membrane 108 may be laid between subfloor 102 and underlayment 106.

Those skilled in the art will further recognize that in certain floor constructions (e.g., shower or bath floors), waterproofing membrane 108 may extend (e.g., by approximately nine to twelve inches) up each side of the walls (not shown) surrounding floor 100.

Floor 100 may also include floor covering 114 laid over waterproofing membrane 108. Floor covering 114 may define drain floor surface 112. The resulting drain floor surface 112 may include a slope matching the slope formed by underlayment 106 to direct water to drain 104.

As one example, floor covering 114 may include tile 110 laid over waterproofing membrane 108. Tile 110 may be adhered to waterproofing membrane 108, for example, by tile cement, thinset cement, mortar, glue or the like. The resulting floor covering 114 (e.g., tile 110) may include a slope matching the slope formed by underlayment 106 to direct water to drain 104. As used herein, "tile" generally refers to any suitable floor covering including, but not limited to, ceramic, stone, marble, granite, porcelain, wood (e.g., teak) or the like.

While the example of FIG. 1 illustrates tile 110 as floor covering 114 of floor 100, those skilled in the art will recognize that other suitable types of floor coverings 114 are also contemplated, such as, but not limited to, a manufactured solid shower pan or the like.

As another non-limiting example (not shown), floor 100 (e.g., a patio floor, a pool deck floor, a basement floor, etc.) may include successive layers of gravel and/or sand covered with bricks, concrete, tile or the like and including a drain (e.g., drain 104).

Those skilled in the art will recognize that the structural features of floor 100 illustrated in FIG. 1 are not necessarily proportioned to correct size.

Floor 100 may further include linear drain system, generally designated 200. Drain system 200 is a trench drain assembly installed into floor 100 and coupled to drain 104. Drain system 200 may collect drain water from drain floor surface 112 of floor 100 and direct the collected water to drain 104 for disposal. Drain system 200 may be installed into any suitable floor 100. In one example of a shower application, drain system 200 may provide drainage for water falling and/or accumulating on the shower floor.

It is contemplated that the disclosed drain system 200 may also be installed in floors of rooms and areas other than showers, and also for drainage of liquids other than water so long as such liquids can flow along the declined drain floor surface 112 to drain system 200.

Figure 2:
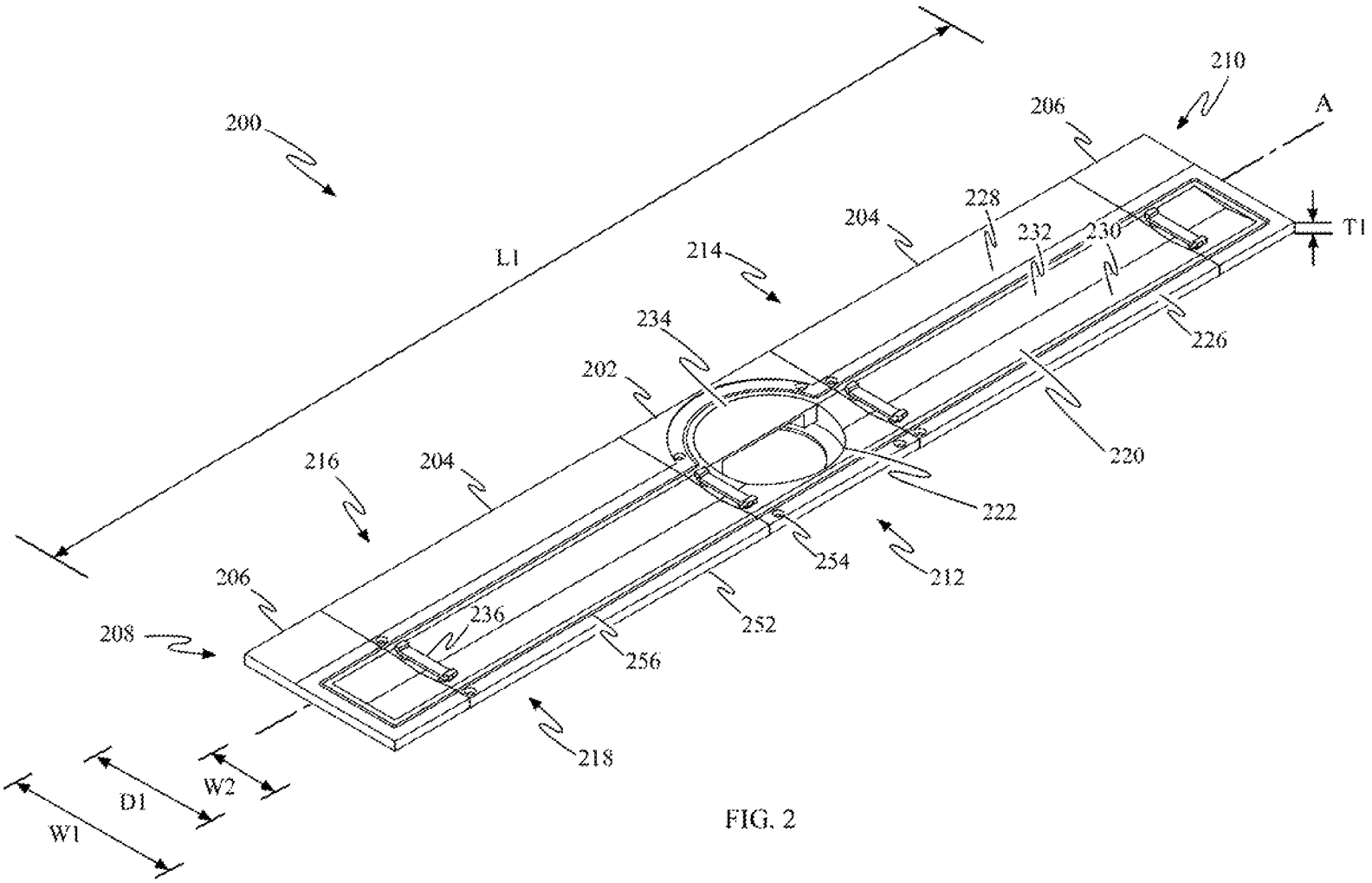
FIG. 2 is a schematic perspective view of one embodiment of the disclosed drain system.

Referring to FIG. 2, disclosed is one embodiment of drain system 200. Drain system 200 may include main body 252. Main body 252 may include first end 208 and a longitudinally opposed second end 210. Main body 252 may include first side 212 and a laterally opposed second side 214. Main body 252 may include top surface 216 and an opposed bottom surface 218 (not visible in FIG. 2). Main body 252 may include a longitudinal dimension, referred to herein as length L1, a lateral dimension, referred to herein as width W1, and a thickness dimension, referred to herein as thickness T1.

Unless otherwise indicated, the terms "first," "second," etc. are used herein merely as labels, and are not intended to impose ordinal, positional, or hierarchical requirements on the items to which these terms refer. Moreover, reference to a "second" item does not require or preclude the existence of a lower-numbered item (e.g., a "first" item) and/or a higher-numbered item (e.g., a "third" item).

Main body 252 or each individual component forming main body 252 (e.g., hub 202, extension 204 and/or end caps 206) (FIGS. 6, 8, 10 and 12) may include a relatively small thickness T1 relative to the width W1. As one example, the thickness T1 may be no more than approximately 20 percent of the width W1. As another example, the thickness T1 may be no more than approximately 10 percent of the width W1. As another example, the thickness T1 may be no more than approximately 5 percent of the width W1. As yet another example, the thickness T1 of main body may be no greater than a combined thickness of subfloor 102 and underlayment 106 (FIG. 1).

The small thickness to width ratio of main body 252 may allow drain system 200 to be installed without modification to floor 100 (e.g., lowering subfloor 102 or raising drain floor surface 112).

Referring to FIG. 2, and with reference to FIG. 1, drain system 200 may include drain opening 222 extending completely through main body 252 (e.g., from top surface 216 to bottom surface 218). Drain opening 222 may be centrally positioned (e.g., laterally) between first side 212 and second side 214 (e.g., a central longitudinal axis A of drain system 200 may bisect drain opening 222). Drain opening 222 may be positioned directly over and fluidly coupled to drain 104 (FIG. 1). The location of drain opening 222 may be dictated, for example, by the particular application, the location of drain 104, the overall length L1 of drain system 200 and the like.

While the examples of FIG. 1 and FIG. 2 illustrates drain system 200 having a single drain opening 222 configured to be installed within floor 100 having a single drain 104, drain system 200 may include more than one drain opening 222 formed through main body 252 to accommodate floor 100 having more than one drain 104.

Drain system 200 may include a linear drain channel 220 formed in top surface 216 of main body 252. Drain channel 220 may extend longitudinally from proximate (e.g., at or near) first end 208 to proximate second end 210. Thus, drain channel 220 may run substantially the entire length L1 of drain system 200. Drain channel 220 may intersect and be in fluid communication with drain opening 222.

Drain channel 220 may be longitudinally sloped (e.g., angled/pitched) downwardly from first end 208 and second end 210, respectively, to drain opening 222. The longitudinal slope of drain channel 220 may cause water, for example, entering drain channel 220 from drain floor surface 112 (FIG. 1), to flow, under the force of gravity, to drain opening 222.

Drain channel 220 may serve as a drainage trough (e.g., a fluid flow path) to collect water from drain floor surface 112 (FIG. 1) and direct the collected water to drain opening 222 and ultimately to drain 104. Accordingly, drain opening 222 may serve as an outlet for drain channel 220. Upon draining through drain opening 222, the water flows through drain 104 and into a plumbing network of the environment into which drain system 200 is installed (e.g., such as house plumbing, of which drain 104 is a part).

Top surface 216 may include first horizontal surface 226 extending laterally from first side 212 toward the longitudinal axis A and second horizontal surface 228 extending laterally from second side 214 toward the longitudinal axis A. Top surface 216 may further include first sloped (e.g., angled/pitched) surface 230 depending downwardly and extending laterally from first horizontal surface 226 and second sloped surface 232 depending downwardly and extending laterally from second horizontal surface 228 and intersecting first sloped surface 230. First sloped surface 230 and second sloped surface 232 may form drain channel 220. Drain channel 220 may be open facing upwards. Drain channel 220 may include a V-shape in cross-section, as best illustrated in FIGS. 1, 6, 8, 10, 12 and 14.

First horizontal surface 226 and second horizontal surface 228 may allow the construction of floor 100 (e.g., waterproof membrane 108 and/or floor covering 114) to extend up to drain channel 220, as illustrated in FIG. 1. First horizontal surface 226 and second horizontal surface 228 may each be substantially flat. First horizontal surface 226 and second horizontal surface 228 may be co-planar. First sloped surface 230 and second sloped surface 232 may each be substantially flat, as best illustrated in FIGS. 1, 6, 8, 10, 12 and 14. Alternatively, first sloped surface 230 and second sloped surface 232 may each include a slight curve in the lateral direction (not explicitly illustrated).

The interior of drain channel 220 may be formed such that the corners where first sloped surface 230 meets first horizontal surface 226 and where second sloped surface 232 meets second horizontal surface 228 form relatively sharp angle corners, as best illustrated in FIGS. 1, 6, 8, 10, 12 and 14. Alternatively, the interior of drain channel 220 may be formed such that the corners where first sloped surface 230 meets first horizontal surface 226 and where second sloped surface 232 meets second horizontal surface 228 form curved corners (not explicitly illustrated).

Figure 3:
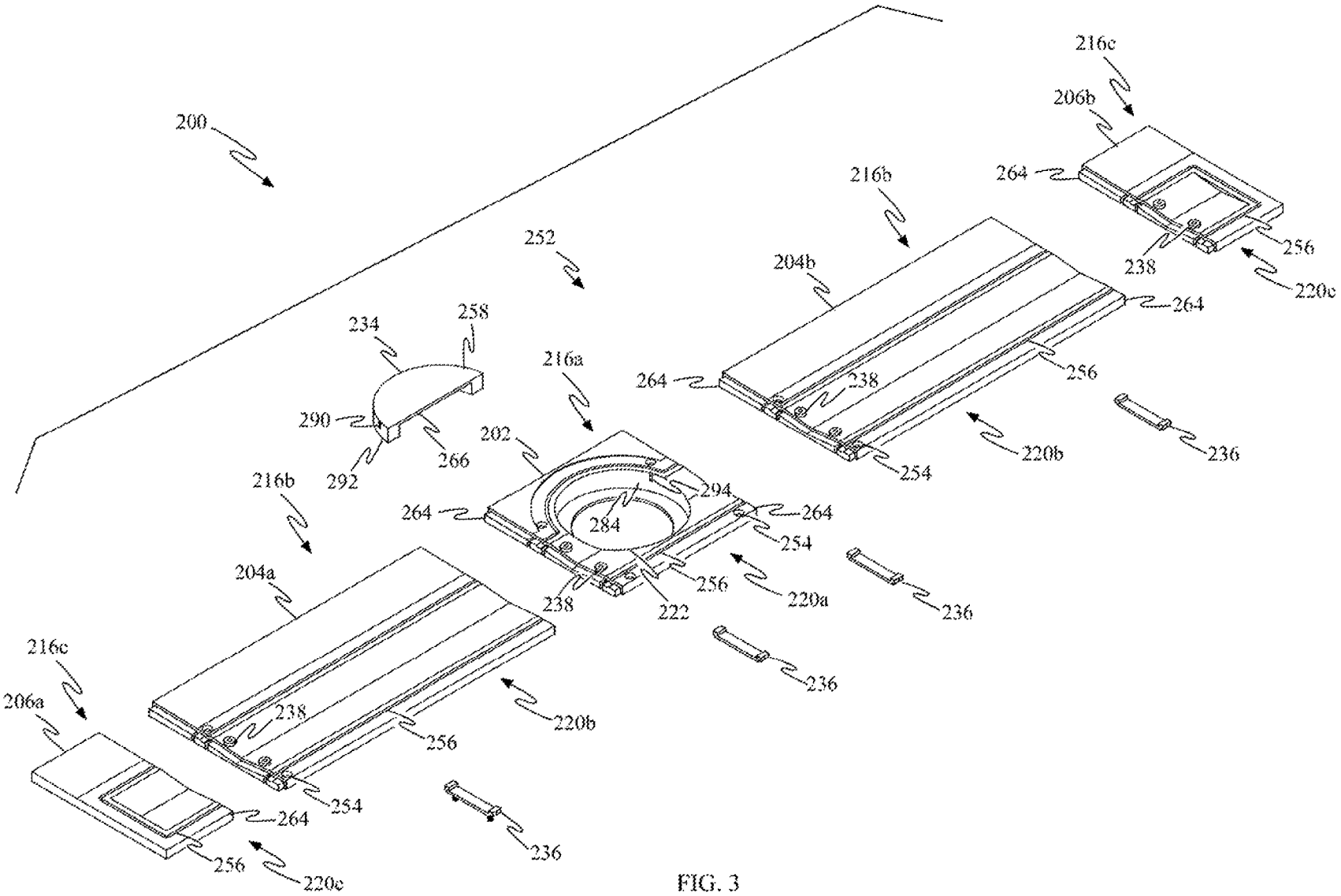
FIG. 3 is a schematic exploded perspective view of the drain system of FIG. 2.

Referring to FIGS. 2 and 3, in one example embodiment, main body 252 may include a plurality of interconnected components to define length L1 (FIG. 2). As one example, drain system 200 may include drain hub 202, also referred to herein as hub 202, one or more linear extensions 204, also referred to herein as extensions 204, and at least two end caps 206. The total number of components forming main body 252 of drain system 200 (e.g., hubs 202, extensions 204 and/or end caps 206) may be dictated, for example, by the particular application (e.g., the type of floor 100), the overall length L1 of drain system 200, the number of drains 104 (FIG. 1) and the like.

As one non-limiting example, and as illustrated in FIG. 2 and FIG. 3, main body 252 may include one hub 202 (e.g., associated with drain 104) (FIG. 1), a pair of elongated extensions 204 coupled (e.g., connected, attached or otherwise joined) to and extending in a straight line outwardly from opposed ends of hub 202 and a pair of longitudinally opposed end caps 206 coupled to terminating ends of extensions 204.

As used herein, the terms "coupled," "connected," "attached," and "joined" mean associated directly as well as indirectly. As a general example, a member A may be directly associated with a member B, or may be indirectly associated therewith, for example, via another member C. As a specific example, end cap 206 may be directly associated with an end of hub 202, or may be indirectly associated with an end of hub 202, for example, via one or more extensions 204. It can be understood that not all relationships among the various disclosed components of main body 252 (e.g., hub 202, extensions 204 and/or end caps 206) are necessarily represented. Accordingly, couplings other than those depicted in the illustrated examples may also exist Referring to FIG. 18, as another non-limiting example, main body 252 may include one elongated hub 202 (e.g., associated with drain 104) (FIG. 1) and a pair of longitudinally opposed end caps 206 coupled to terminating ends of hub 202.

Referring to FIG. 3, hub 202 may include hub top surface 216*a*, each extension 204 may include extension top surface 216*b* and each end cap 206 may include end cap top surface 216*c*. Hub top surface 216*a*, extension top surfaces 216*b* and end cap top surfaces 216*c* may each define longitudinal sections of top surface 216 of main body 252. Similarly, hub 202 may include hub drain channel 220*a*, each extension 204 may include extension drain channel 220*b* and each end cap 206 may include end cap drain channel 220*c*. Hub drain channel 220*a*, extension drain channels 220*b* and end cap drain channels 220*c* may each define longitudinal sections of drain channel 220 of main body 252.

As another non-limiting example, main body 252 may be a single longitudinal piece made of the same base material. For instance, main body 252 may be formed monolithically.

In such an example, the overall length L1 of drain system 200 and the number and location of drain opening 222 may be dictated, for example, by the particular application (e.g., the type of floor 100), the number of drains 104 (FIG. 1) and the like.

Referring briefly to FIGS. 1 and 2, and with reference to FIGS. 6, 8, 10 and 12, drain channel 220 may include a lateral dimension, referred to herein as width W2. The width W2 of drain channel 220 may be less than the width W1 of main body 252 or the width W1 of each individual component forming main body 252 (e.g., hub 202, extension 204 and/or end caps 206) (FIGS. 6, 8, 10 and 12). As one example, the width W2 of drain channel 220 may be no more than fifty percent of the width W1 of the main body 252 (or of each of hub 202, extension 204 and/or end caps 206). As another example, the width W2 of drain channel 220 may be no more than twenty-five percent of the width W1 of the main body 252.

Referring to FIG. 2, in one example, drain channel 220 may be offset from the longitudinal axis A. As one example, drain channel 220 may be positioned on top surface 216 proximate first side 212 of main body 252. In such an example, first horizontal surface 226 may include a lateral dimension less than a lateral dimension of second horizontal surface 228.

The width W2 of drain channel 220 may be less than a lateral dimension D1 (e.g., a diameter) of drain opening 222. As one example, the width W2 of drain channel 220 may be approximately fifty percent of the dimension D1 of drain opening 222. With drain channel 220 being offset from the longitudinal axis A of drain system 200, as illustrated in FIGS. 1 and 2, drain channel 220 may bisect (e.g., divide into two equal or non-equal parts) drain opening 222.

Referring to FIGS. 1-4 and 18, drain system 200 may further include drain opening cover 234, referred to herein as cover 234. Cover 234 may be suitably sized and shaped to cover over any portion of drain opening 222 not in fluid communication with or intersected by drain channel 220. As one example, cover 234 may include a semi-circular shape suitable to cover an open portion of drain opening 222.

Referring to FIGS. 1 and 3, cover 234 may include cover top surface 258 (FIG. 3). Cover top surface 258 may be co-planar with and form a portion of top surface 216 of main body 252. For example, cover top surface 258 may be co-planar with and form a portion of hub top surface 216*a*. Cover top surface 258 may allow the construction of floor 100 (e.g., waterproof membrane 108 and/or floor covering 114) to extend up to drain channel 220 over top of a portion of drain opening 222, as illustrated in FIG. 1.

Referring to FIGS. 2 and 3, cover top surface 258 may include a straight edge 266 (FIG. 3). Edge 266 may be longitudinally aligned with a portion of drain channel 220 intersecting drain opening, as illustrated in FIG. 2. Thus, cover top surface 258 may define a portion of second horizontal surface 228 of main body 252 or of hub 202.

Referring to FIG. 1, and with reference to FIGS. 6, 8, 10 and 12, drain channel 220 may include a thickness dimension, referred to herein as thickness T2. The thickness T2 of drain channel 220 may be less than the thickness T1 of main body 252 or the thickness T1 of each individual component forming main body 252 (e.g., hub 202, extension 204 and/or end caps 206) (FIGS. 6, 8, 10 and 12). As one example, the thickness T2 of drain channel 220 may be no more than ninety percent of the thickness T1 of main body 252 (or of each of hub 202, extension 204 and/or end caps 206). As another example, the thickness T2 of drain channel 220 may be no more than seventy-five percent of the thickness T1 of main body 252. As another example, the thickness T2 of drain channel 220 may be no more than fifty percent of the thickness T1 of main body 252. As another example, the thickness T2 of drain channel 220 may be no more than twenty-five percent of the thickness T1 of main body 252.

Figure 4:
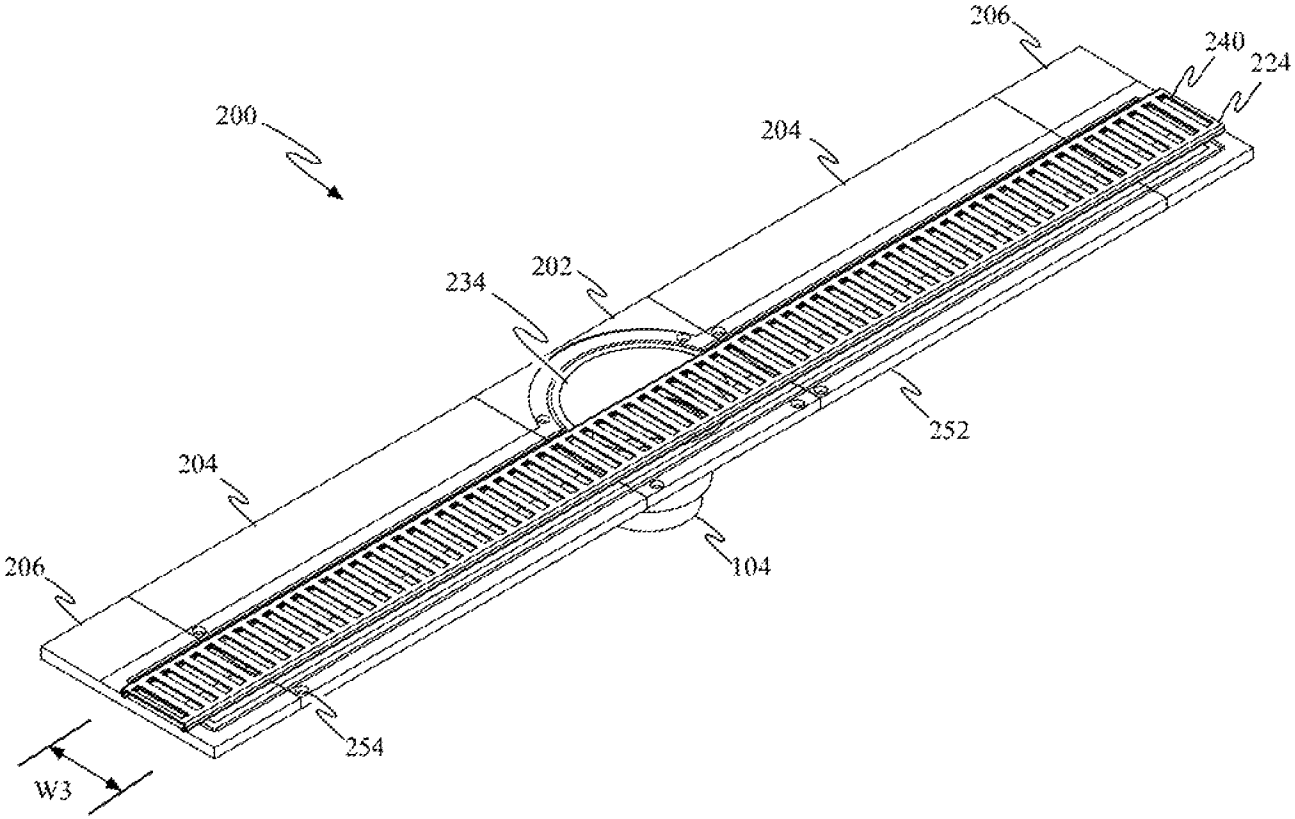
FIG. 4 is a schematic perspective view of another embodiment of the disclosed drain system.

Referring to FIG. 4, and with reference to FIG. 1, drain system 200 may include grate 224. Grate 224 may be positioned over top of drain channel 220. Grate 224 may include a plurality of grate inlet openings 240. Grate 224 may serve to prevent objects of a predetermined size from draining into drain channel 220 and into drain 104. Grate 224 may be formed as a separate piece relative to main body 252 or each individual component forming main body 252 (e.g., hub 202, extension 204 and/or end caps 206). In other words, grate 224 may not be formed integral to main body 252, but may be an add-on piece.

Grate 224 may be suitably sized to substantially match drain channel 220. For example, grate 224 may include a lateral dimension, referred to herein as width W3 (FIG. 2), substantially equal to the width W2 of drain channel 220. Grate 224 may also include a longitudinal dimension (e.g., length) substantially equal to a longitudinal dimension (e.g., length) of drain channel 220.

While the example of FIG. 4 illustrates a single elongated grate 224 covering the entire length of drain channel 220, grate 224 may alternatively include a plurality of longitudinally aligned grate sections positioned over top of drain channel 220 (not explicitly illustrated).

Referring to FIG. 1, and with reference to FIG. 2 and FIG. 3, drain system 200 may further include a plurality of grate supports 236. Grate 224 may rest directly on and be supported by grate supports 236. Grate supports 236 may be coupled to main body 252. Grate supports 236 may be positioned within drain channel 220. As one example, and as best illustrated in FIG. 2, grate supports 236 may be coupled to and supported by first sloped surface 230 and second sloped surface 232. The number of grate supports 236 may be dictated by, for example, the length L1 of drain system 200.

Figure 14:
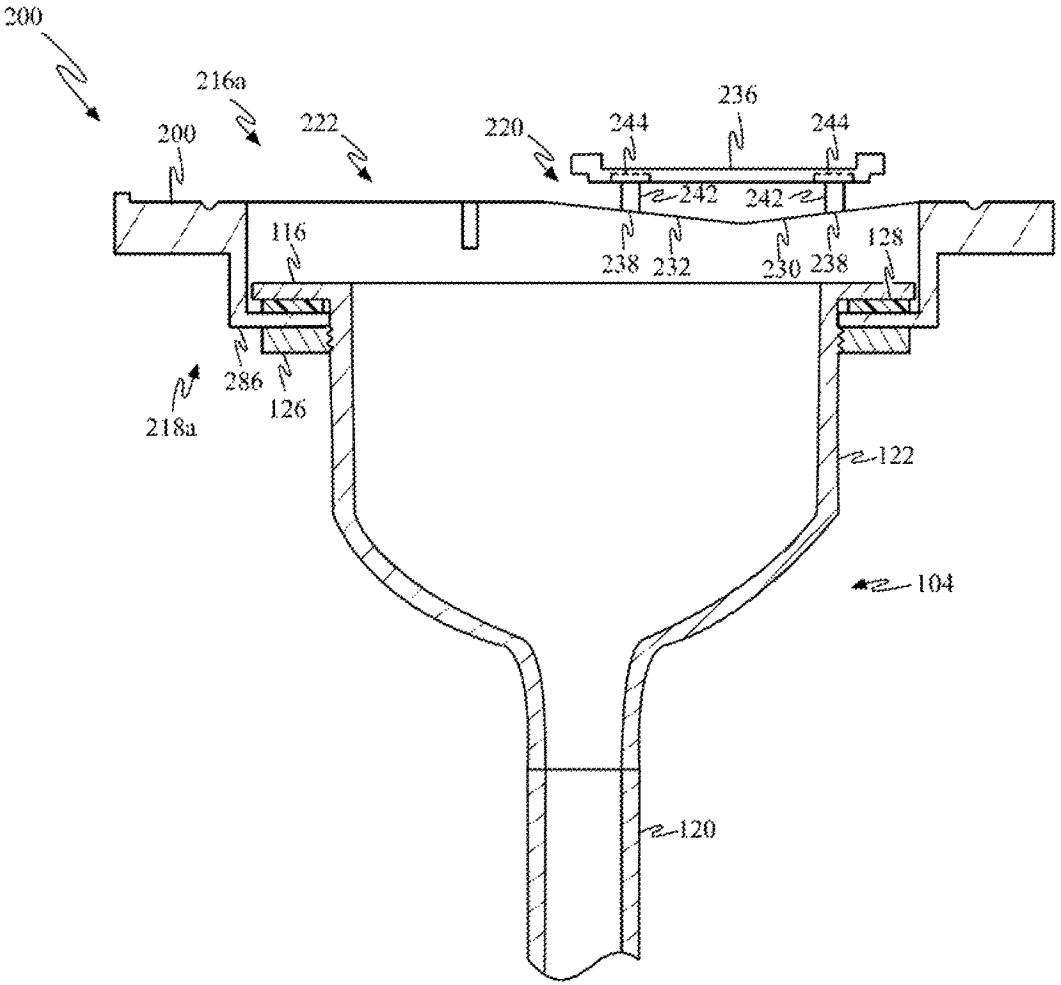
FIG. 14 is a schematic elevational view, in section, of the disclosed drain system and drain.

Referring to FIG. 1, and with reference to FIG. 3 and FIG. 14, drain system 200 may include a plurality of height adjusters 238. Height adjusters 238 may be longitudinally spaced apart along drain channel 220. Each grate support 236 may rest directly on and be supported by laterally aligned and spaced apart pairs of height adjusters 238. Height adjusters 238 may adjust a vertical position (e.g., height) of grate support 236 and, thus, grate 224 (FIG. 1) relative to main body 252 or each individual component forming main body 252 (e.g., hub 202, extension 204 and/or end caps 206). As illustrated in FIG. 1, height adjusters 238 may allow grate 224 to be positioned in a suitably co-planar relationship with the surface of floor 100 (e.g., with drain floor surface 112).

Referring to FIG. 14, height adjusters 238 may be coupled to main body 252 within drain channel 220. For example, height adjusters 238 may be operatively coupled to first sloped surface 230 and second sloped surface 232. As one example, height adjuster 238 may include a fastener (e.g., a bolt) having a threaded shaft 242 and a head 244. Threaded shaft 242 may be mechanically coupled to and project outwardly from a threaded hole (not explicitly illustrated) formed in first sloped surface 230 and second sloped surface 232.

Figure 17:
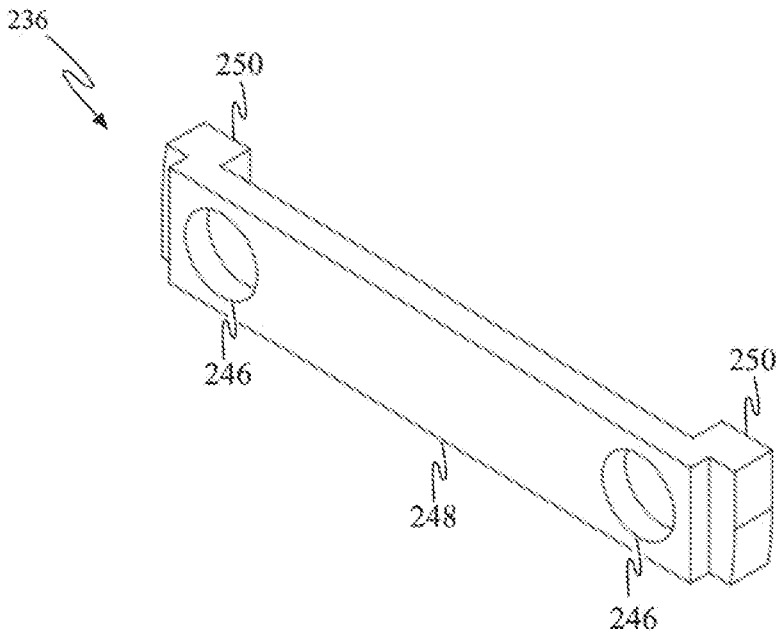
FIG. 17 is a schematic perspective view of one embodiment of a grate support of the disclosed drain system.

Referring to FIG. 17, and with reference to FIG. 14, grate support 236 may include a pair of laterally opposed recesses 246 formed in a bottom surface thereof. Recess 246 may be suitably sized to at least partially receive head 244 of height adjuster 238 (FIG. 14). Grate support 236 may include horizontal member 248 and a pair of laterally opposed shoulders 250 extending upwardly and outwardly from ends of horizontal member 248. Recesses 246 may be formed in a bottom surface of horizontal member 248. Recesses 246 may be located near the laterally opposed ends of horizontal member 248 (e.g., proximate shoulders 250). Grate 224 may rest directly on and be supported by shoulders 250. As one example, grate support 236 may be positioned between an adjacent pair of inlet openings 240 of grate 224 (FIG. 4).

Alternatively, grate 224 may rest directly on first horizontal surface 226 and second horizontal surface 228 of drain system 200 over drain channel 220 (not explicitly illustrated).

Referring to FIGS. 2-8, 13 and 18, drain system 200 may further include a plurality of fastener holes 254 disposed through main body 252 or each individual component forming main body 252 (e.g., hub 202, extension 204 and/or end caps 206). Fastener holes 254 may be longitudinally spaced apart along both sides (e.g., first side 212 and second side 214) of main body 252. For example, a plurality of longitudinally spaced apart fastener holes 254 may be formed through first horizontal surface 226 and a plurality of longitudinally spaced apart fastener holes 254 may be formed through second horizontal surface 228, for example, spaced apart from laterally aligned fastener holes 254. A fastener (not explicitly illustrated), such as a screw, may project through a respective fastener hole 254 to mechanically connect main body 252 or each individual component forming main body 252 (e.g., hub 202, extension 204 and/or end caps 206) to subfloor 102 (FIG. 1).

Referring to FIGS. 2-8, 13 and 18, drain system 200 may further include adhesive channel 256 formed in main body 252 or each individual component forming main body 252 (e.g., hub 202, extension 204 and/or end caps 206). For example, adhesive channel 256 may be a shallow groove or recess formed into top surface 216. Adhesive channel 256 may be configured to receive adhesive bead 124 (e.g., glue or thinset cement) to adhere waterproof membrane 108 (FIG. 1) to top surface 216 of main body 252 or each individual component forming main body 252 (e.g., hub 202, extension 204 and/or end caps 206).

Adhesive channel 256 may completely surround drain channel 220 and drain opening 222 of main body 252. Adhesive channel 256 may extend longitudinally from proximate first end 208 to proximate second end 210. Thus, adhesive channel 256 may run substantially the entire length L1 of drain system 200.

The components of drain system 200 including main body 252 (e.g., hub 202, extensions 204 and/or end caps 206) and/or grate 224 may be made of any suitable material. As one general, non-limiting example, drain system 200 may be made of plastic. As specific, non-limiting examples, drain system 200 may be made from PVC, ABS and the like. As another general, non-liming example, drain system 200 may be made of metal. As specific, non-limiting examples, drain system 200 may be made from galvanized steel, aluminum and the like. Other materials are also contemplated.

The components of drain system 200 may be manufactured by any suitable material forming process or fabrication operation. As one non-limiting example, main body 252 or each individual component forming main body 252 (e.g., hub 202, extension 204 and/or end caps 206) may be extruded. As another non-limiting example, main body 252 may be molded (e.g., injection molded). As another non-limiting example, main body 252 may be machined, for example, by a CNC machine. As another non-limiting example, main body 252 may be additively manufactured. Other manufacturing processes are also contemplated.

Referring to FIG. 3 each component of main body 252 (e.g., hub 202, extensions 204 and/or end caps 206) may include connection feature 264 formed on at least one end thereof. Connection feature 264 serves to interconnect adjacent components of main body 252 in a straight line (e.g., along longitudinal axis A). As one example, hub 202 may include connection feature 264 at both longitudinally opposed (e.g., terminating) ends. As another example, extension 204 may include connection feature 264 at both longitudinally opposed (e.g., terminating) ends. As another example, end cap 206 may include connection feature 264 at one end.

Figure 15:
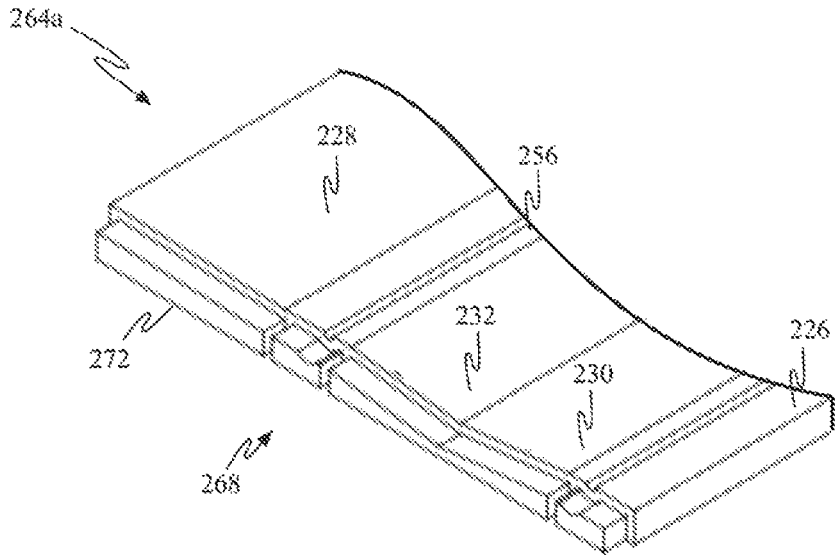
FIG. 15 is a schematic perspective view of one embodiment of a connection feature of the disclosed drain system.
Figure 16:
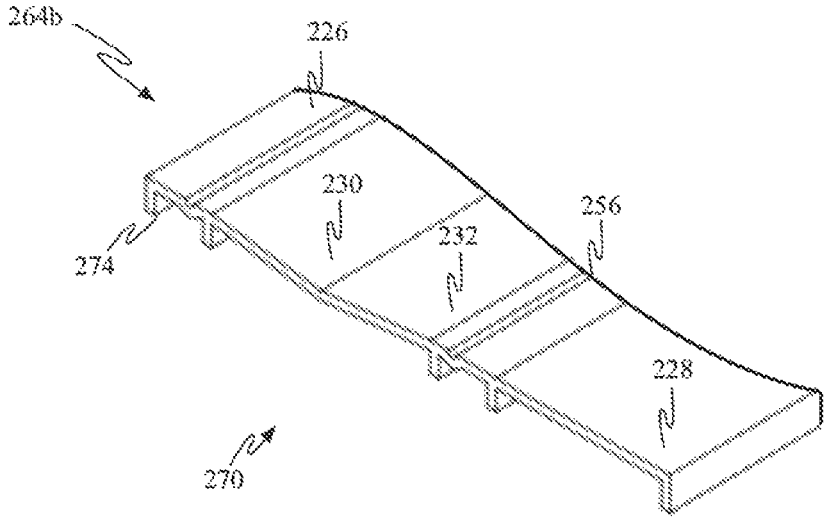
FIG. 16 is a schematic perspective view of another embodiment of the connection feature of the disclosed drain system.

Referring to FIGS. 15 and 16, connection feature 264 may include one of first interlocking feature 268 or second interlocking feature 270. For example, first connection feature 264*a* (FIG. 15) may include first interlocking feature 268 and second connection feature 264*b* (FIG. 16) may include second interlocking feature 270. First interlocking feature 268 and second interlocking feature 270 may operatively engage one another to connect the components of main body 252. As one general, non-limiting example, connection feature 264 may include a tongue and groove connection.

Figure 18:
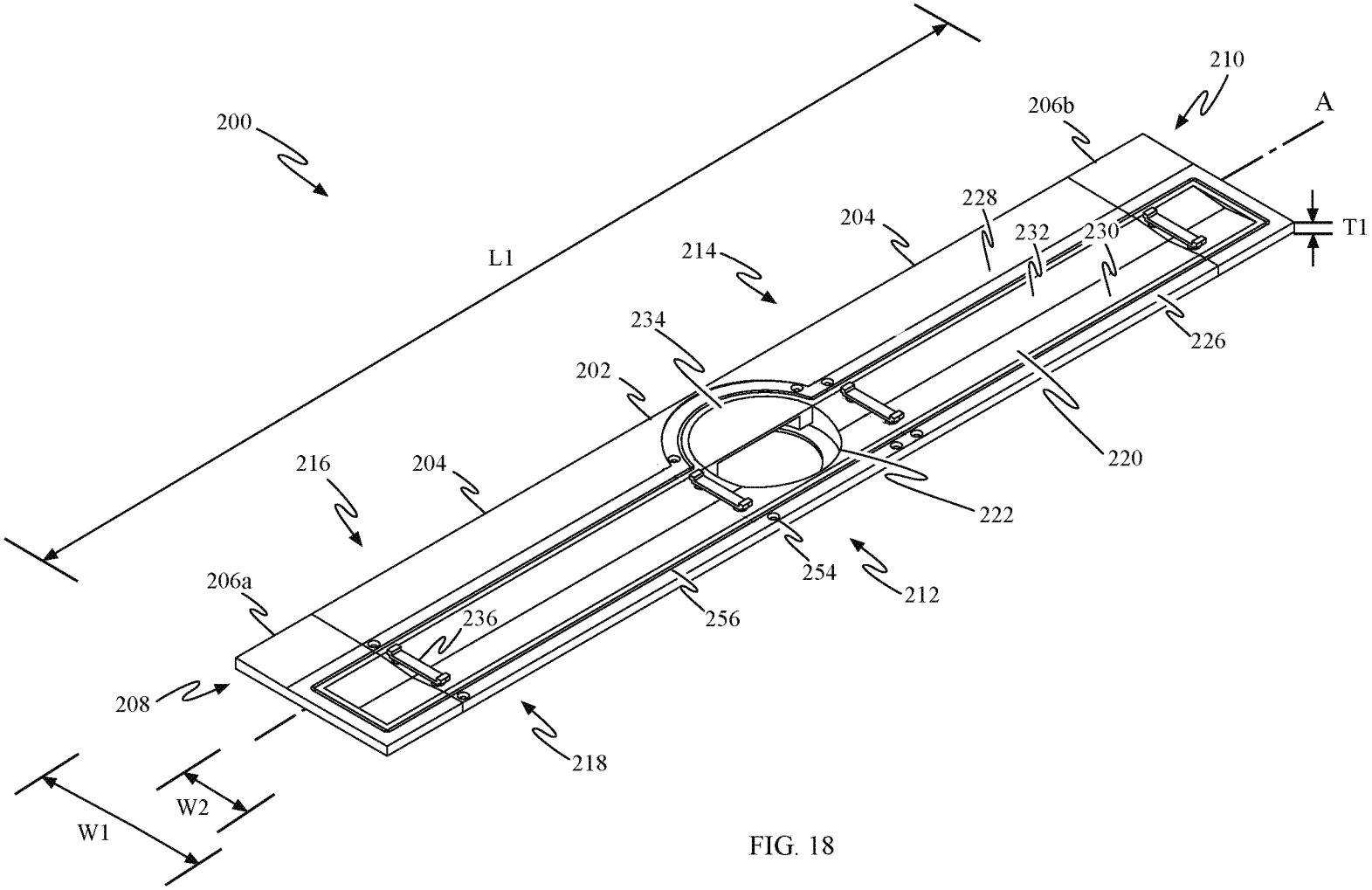
FIG. 18 is a schematic perspective view of another embodiment of the disclosed drain system.

As one example, and as best illustrated in FIG. 15, first interlocking feature 268 may include one or more tabs 272 (e.g., tongues or ridges) extending (e.g., longitudinally outward) from one end (e.g., first end 208 or second end 210) of each component of main body 252 (e.g., hub 202, extension 204 and/or end cap 206). As one example, and as best illustrated in FIG. 16, second interlocking feature 270 may include one or more slots 274 (e.g., recesses or grooves) formed (e.g., longitudinally inward) in one end (e.g., first end 208 or second end 210) of each component of main body 252 (e.g., hub 202, extension 204 and/or end cap 206). Slots 274 may be configured to receive tabs 272 for connection of adjacent components of main body 252 (e.g., hub 202, extension 204 and/or end cap 206) (FIGS. 2, 3 and 18).

Figure 6:
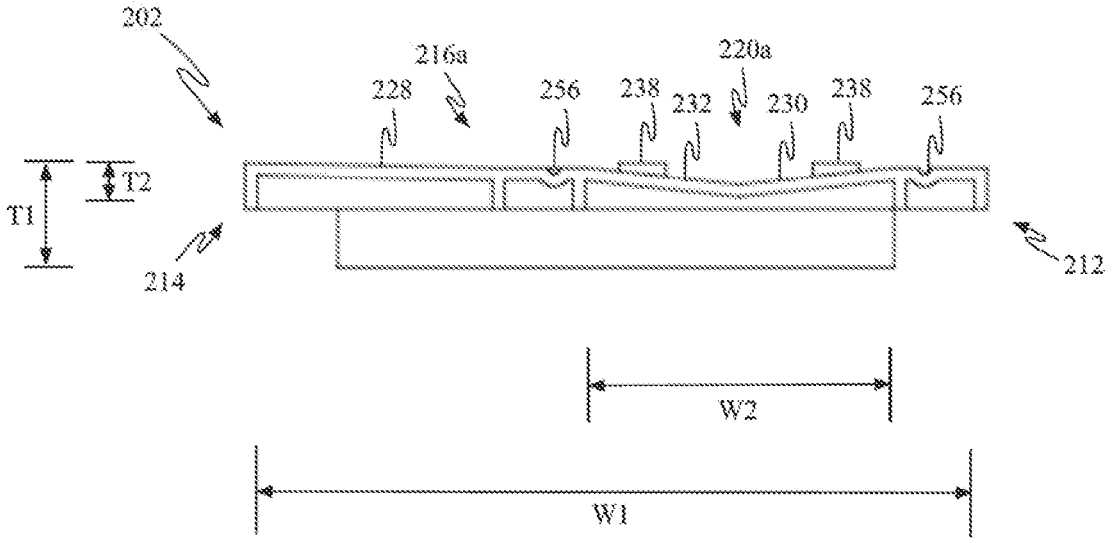
FIG. 6 is a schematic elevational end view of the hub of FIG. 5.
Figure 7:
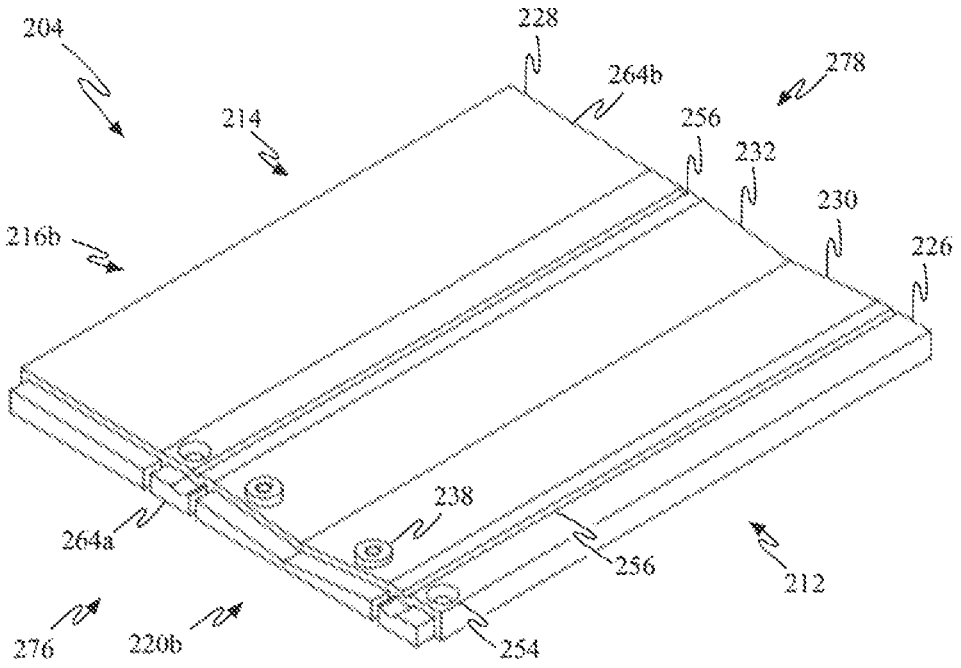
FIG. 7 is a schematic perspective view of one embodiment of an extension of the disclosed drain system.
Figure 9:
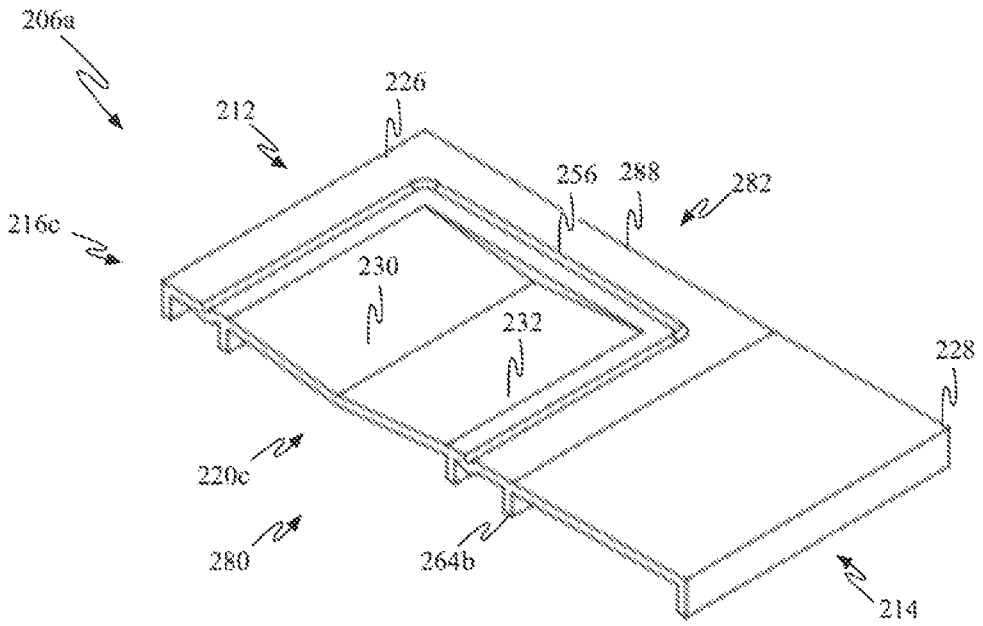
FIG. 9 is a schematic perspective view of one embodiment of an end cap of the disclosed drain system.
Figure 11:
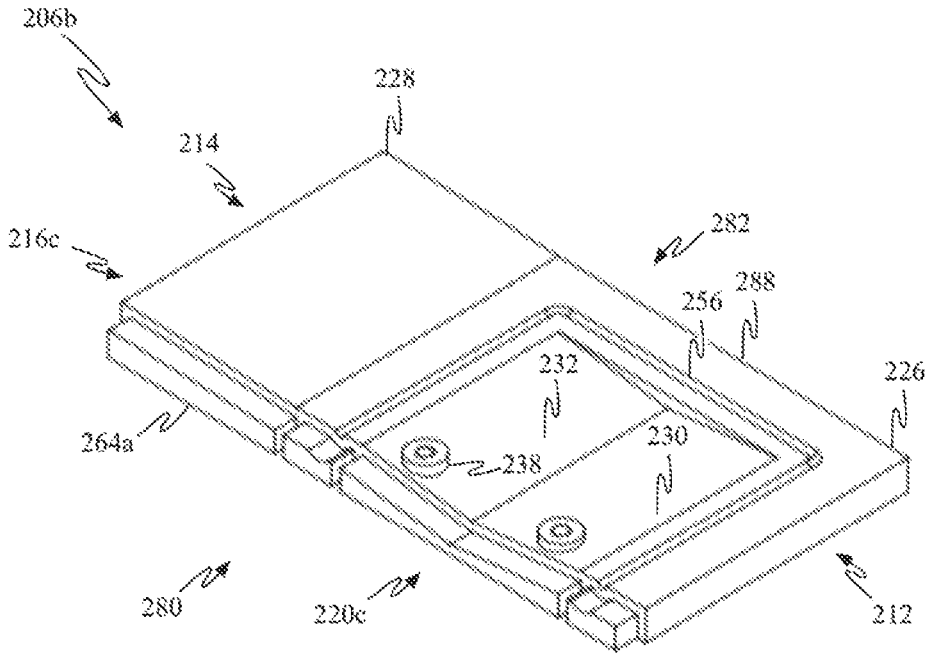
FIG. 11 is a schematic perspective view of another embodiment of the end cap of the disclosed drain system.
Figure 13:
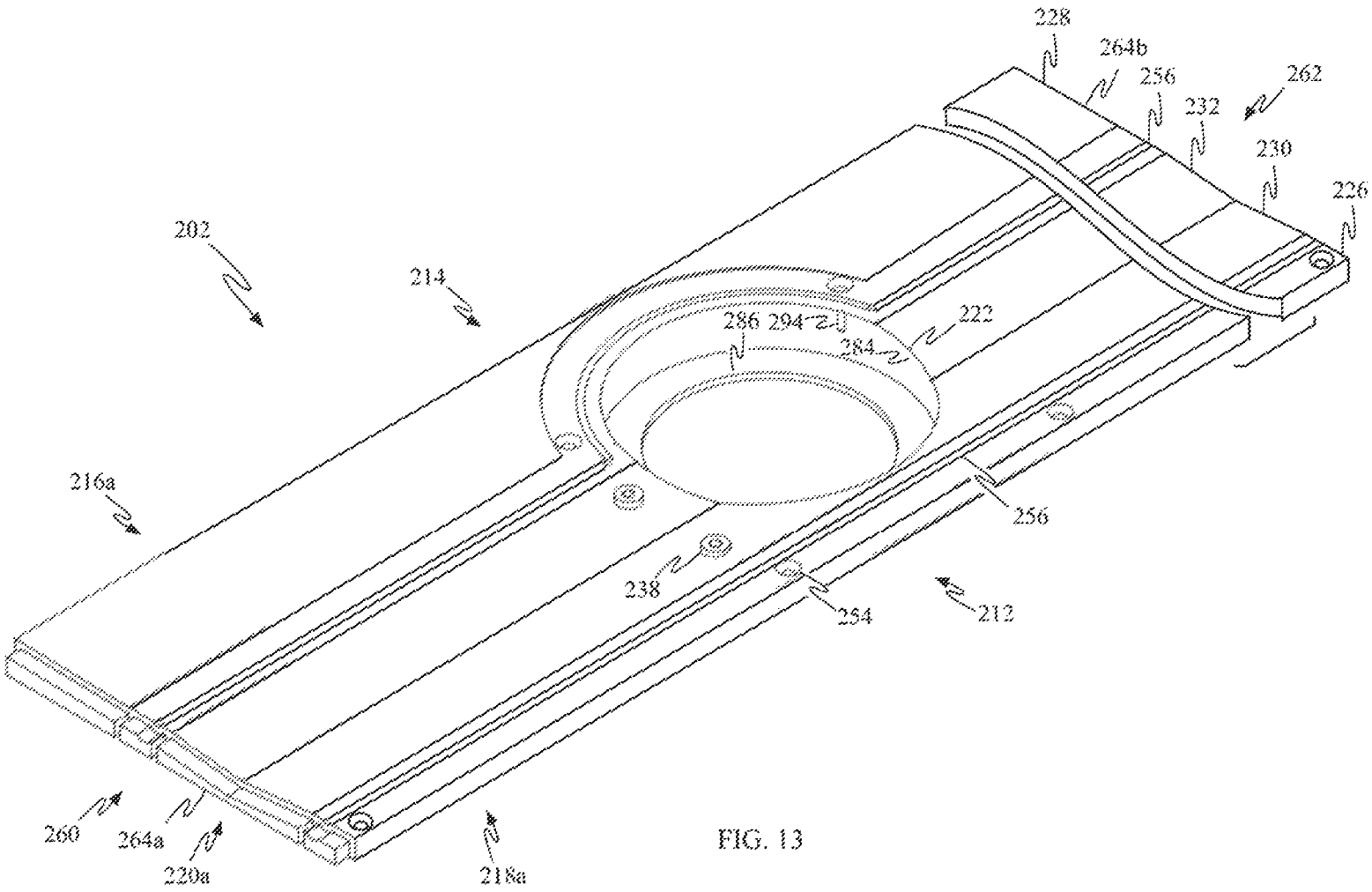
FIG. 13 is a schematic perspective view of another embodiment of the hub of the disclosed drain system.

As one example, and as illustrated in FIGS. 6 and 13, hub 202 may include first interlocking feature 268 (e.g., one or more tabs 272) extending from first end 260 of hub 202 and second interlocking feature 270 (e.g., one or more slots 274) formed in second end 262 of hub 202. As another example, and as illustrated in FIG. 7, extension 204 may include first interlocking feature 268 extending from first end 276 of extension 204 and second interlocking feature 270 formed in second end 278 of extension 204. As another example, and as illustrated in FIGS. 9 and 11, first end cap 206*a* may include second interlocking feature 270 (e.g., one or more tabs 272) formed in first end 280 of first end cap 206*a* and second end cap 206*b* may include first interlocking feature 268 extending from first end 280 of second end cap 206*b*.

As illustrated in FIGS. 2 and 3, and with reference to FIGS. 5, 7, 9 and 11, in one example, first interlocking feature 268 of first end 260 of hub 202 may engage second interlocking feature 270 of second end 278 of one extension 204 (e.g., first extension 204*a*) (FIG. 3) to join hub 202 and first extension 204*a*. First interlocking feature 268 of first end 276 of another extension 204 (e.g., second extension 204*b*) (FIG. 3) may engage second interlocking feature 270 of second end 262 of hub 202 to join hub 202 and second extension 204*b*. First interlocking feature 268 of first end 276 of first extension 204*a* may engage second interlocking feature 270 of first end 280 of first end cap 206*a* to join first extension 204*a* and first end cap 206*a*. First interlocking feature 268 of first end 280 of second end cap 206*b* may engage second interlocking feature 270 of second end 278 of second extension 204*b* to join second extension 204*b* and second end cap 206*b*.

Alternatively, the components of main body 252 (e.g., hub 202, extension 204 and end caps 206) may further be adhesively bonded together. As one example, hub 202 may include an adhesive (not explicitly illustrated) applied at one or both longitudinally opposed ends (e.g., first end 260 and/or second end 262). As another example, extension 204 may include the adhesive applied at one or both longitudinally opposed ends (e.g., first end 276 and/or second end 278). As another example, end cap 206 may include the adhesive applied at one end (e.g., first end 280). Depending upon the configuration of main body 252 (e.g., the length of hub 202 and/or the number of extensions 204) one of extension 204 or end cap 206 may be connected (e.g., directly connected) to hub 202 by the adhesive and/or end cap 206 may be connected to extension 204 by the adhesive.

Alternatively still, the use of connection features 264 (e.g., first interlocking feature 268 and second interlocking feature 270) and the adhesive may be used to connect the components of main body 252 (e.g., hub 202, extension 204 and end caps 206). For example, first interlocking feature 268 and second interlocking feature 270 may make an initial connection between adjacent ends of hub 202, extension 204 and/or end cap 206 and the adhesive may secure the connection between first interlocking feature 268 and second interlocking feature 270.

While the example of FIGS. 2-4 illustrate main body 252 including only two extensions 204 (e.g., first extension 204*a* and second extension 204*b*) (FIG. 3), additional extensions 204 (not explicitly illustrated) may be interconnected, as necessary, to define length L1 of main body 252. Regardless of the number of extensions 204 used to form main body 252, two end caps 206 (e.g., first end cap 206*a* and second end cap 206*b*) may be joined to longitudinally opposed terminating ends of the last extension 204.

As illustrated in FIG. 18, and with reference to FIGS. 5, 7, 9 and 11, in another example, first interlocking feature 268 of first end 260 of hub 202 may engage second interlocking feature 270 of first end 278 of one end cap (e.g., first end cap 206*a*) to join hub 202 and first end cap 206*a*. First interlocking feature 268 of first end 280 of another end cap (e.g., second end cap 206*b*) may engage second interlocking feature 270 of second end 262 of hub 202 to join hub 202 and second end cap 206*b*.

Figure 5:
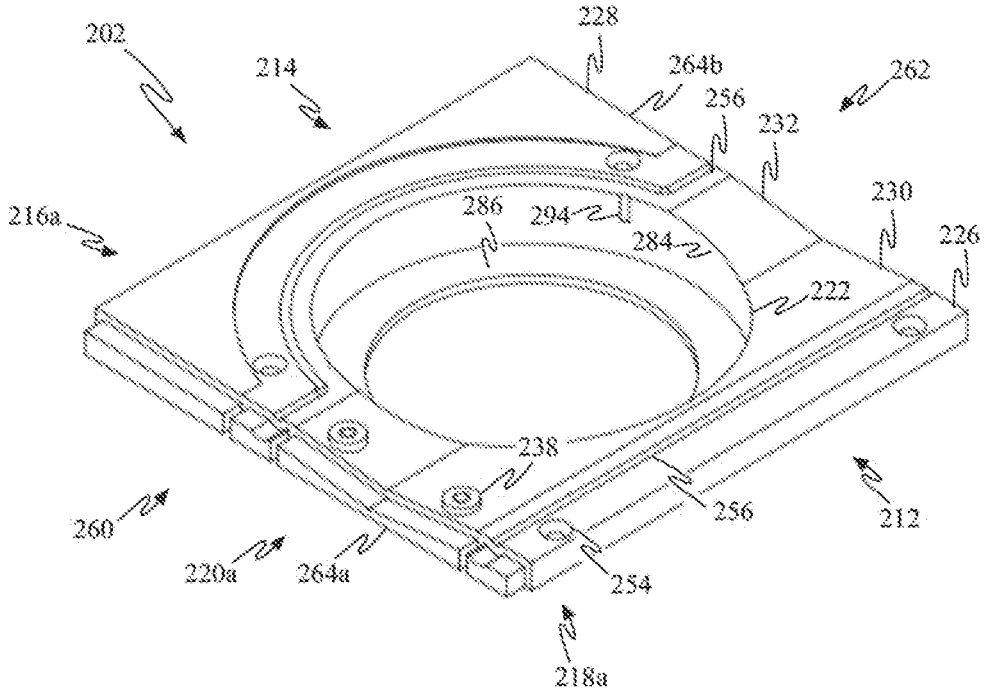
FIG. 5 is a schematic perspective view of one embodiment of a hub of the disclosed drain system.

Referring to FIGS. 5, 6 and 13, drain channel 220 may completely extend from first end 260 of hub 202 to second end 262 of hub 202, for example, defining hub drain channel 220*a*. Similarly, adhesive channel 256 may completely extend from first end 260 of hub 202 to second end 262 of hub 202. Thus, as one example, hub 202 may include two laterally opposed and substantially parallel longitudinal sections of adhesive channels 256, for example, formed in first horizontal surface 226 and second horizontal surface 228, respectively, on either side of hub drain channel 220*a*. One adhesive channel 256 may extend around a portion of a perimeter of drain opening 222 formed through hub 202.

Referring to FIGS. 5 and 13, drain opening 222 may define a continuous (e.g., circular) side wall 284 extending from hub top surface 216*a* to hub bottom surface 218*a*. Flange 286 may extend circumferentially inward from side wall 284 proximate hub bottom surface 218*a*. As one example, flange 286 may be a portion of hub bottom surface 218. For instance, drain opening 222 at hub top surface 216*a* may have a larger lateral dimension D1 (e.g., diameter) than drain opening 222 at hub bottom surface 218, for example, as defined by an internal lateral dimension (e.g., diameter) of flange 286.

Referring to FIGS. 1 and 14, hub 202 may be connected to drain 104 such that drain channel 220 and drain opening 222 are in fluid communication with drain 104. Drain opening 222 may be connected to any type of drain configuration. Drain 104 may include drain flange 116 extending circumferentially outward at a terminating (e.g., upper) end thereof, for example, a portion of drain 104 extending at least partially through subfloor 102 (FIG. 1). As one example, and as illustrated in FIG. 1, drain 104 may include drainpipe 120 including drain flange 116. As another example, and as illustrated in FIG. 14, drain 104 may include drain fixture 122 including drain flange 116. Drainpipe 120 may be coupled to drain fixture 122.

Drain opening 222 may be configured (e.g., suitably sized and/or shaped) to fit around drain 104. Drain flange 116 may rest on flange 286 of hub 202 within drain opening 222. Drain fastener 118 may be operatively coupled around drain 104 (e.g., around drainpipe 120 or drain fixture 122) opposite drain flange 116 with flange 286 positioned therebetween. Drain fastener 118 may be tightened to compress flange 286 between drain flange 116 and drain fastener 118. As one example, drain fastener 118 may include a locking nut threadably coupled to an exterior of drain 104 (e.g., drainpipe 120 or drain fixture 122).

Gasket 128 may be positioned between flange 286 and drain flange 116. As one example, gasket 128 may include an annular rubber member suitably to seal an interface between drain flange 116 and flange 286.

Referring to FIG. 3, and with reference to FIG. 1, cover 234 may rest on drain flange 116 (FIG. 1). Cover 234 may include at least one retaining tab 290 projecting outwardly from a semi-circular side wall 292 of cover 234. Side wall 284 of drain opening 222 may include at least one retaining slot 294 formed therein. As one example, retaining tab 290 may extend downwardly (e.g., vertically) from cover top surface 258 along an exterior of side wall 292 of cover. Retaining slot 294 may extend downwardly (e.g., vertically) from hub top surface 216*a* within side wall 284 defining drain opening 222. Upon cover 234 being positioned within drain opening 222 and resting on drain flange 116 (FIG. 1), retaining slot 294 may receive retaining tab 290 to retain cover 234 at a lateral position within drain opening 222. In one example, cover 234 may include a pair of longitudinally opposed retaining tabs 290 and drain opening 222 may include a pair of longitudinally opposed retaining slots 294 (not visible in FIG. 3).

Referring to FIGS. 2-5, as one example, hub 202 may have a relatively shortened longitudinal dimension (e.g., length). For example, hub 202 may be suitably sized to fit over and be coupled to drain 104. In such an example, one or more extensions 204 may form the majority of the length L1 of main body 252. For example, extensions 204 may extend outwardly in a straight line from longitudinally opposed ends (e.g., first end 260 and second end 262) of hub 202 a desired distance and end caps 206 may be coupled to extensions 204. Further, in such an example, drain opening 222 may be pre-formed, for example, during a manufacturing (e.g., molding) process. Drain opening 222 may be formed substantially at a center (e.g., a longitudinal center and lateral center) of hub 202.

Referring to FIGS. 13 and 18, as another example, hub 202 may have an elongated longitudinal dimension (e.g., length). In such an example, hub 202 may form the majority of the length L1 of main body 252. For example, hub 202 may extend outwardly in a straight line a desired distance. Further, in such an example, drain opening 222 may be formed (e.g., machined) post-manufacturing and pre-installation. Drain opening 222 may be formed at any longitudinal location of hub 202, for example, as dictated by the location of drain 104 (FIG. 1). Drain opening 222 may still be formed substantially at the lateral center of hub 202.

Figure 8:
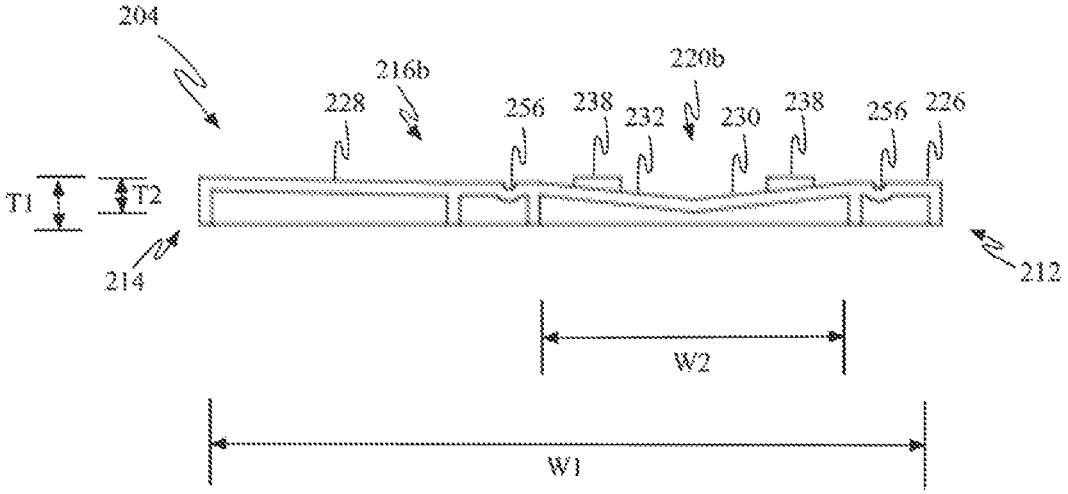
FIG. 8 is a schematic elevational end of the extension of FIG. 7.

Referring to FIGS. 7 and 8, drain channel 220 may completely extend from first end 276 of extension 204 to second end 278 of extension 204, for example, defining extension drain channel 220*b*. Similarly, adhesive channel 256 may completely extend from first end 276 of extension 204 to second end 278 of extension 204. Thus, as one example, extension 204 may include two laterally opposed and substantially parallel longitudinal sections of adhesive channels 256, for example, formed in first horizontal surface 226 and second horizontal surface 228, respectively, on either side of extension drain channel 220*b*.

Figure 10:
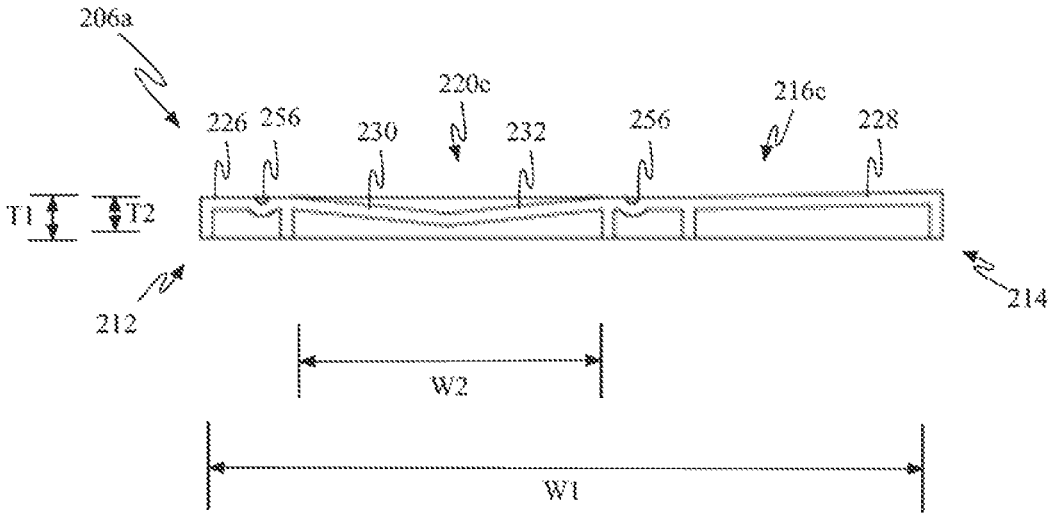
FIG. 10 is a schematic elevational end of the end cap of FIG. 9.

Referring to FIGS. 9 and 10, drain channel 220 may extend from first end 280 of first end cap 206*a* to proximate second end 282 of first end cap 206*a*, for example, defining end cap drain channel 220*c*. Similarly, adhesive channel 256 may extend from first end 280 of first end cap 206*a* to proximate second end 282 of first end cap 206*a*. Thus, as one example, first end cap 206*a* may include two laterally opposed and substantially parallel longitudinal sections of adhesive channels 256, for example, formed in first horizontal surface 226 and second horizontal surface 228, respectively, on either side of end cap drain channel 220*c* and a lateral adhesive channel 256 proximate an end of end cap drain channel 220*c*. End cap top surface 216*c* may also include third horizontal surface 288 extending laterally between first horizontal surface 226 and second horizontal surface 228. Third horizontal surface 288 of first end cap 206*a* may form an end of (e.g., a closing of) end cap drain channel 220*c* (e.g., first end cap drain channel). The lateral adhesive channel 256 may be formed in third horizontal surface 288.

Figure 12:
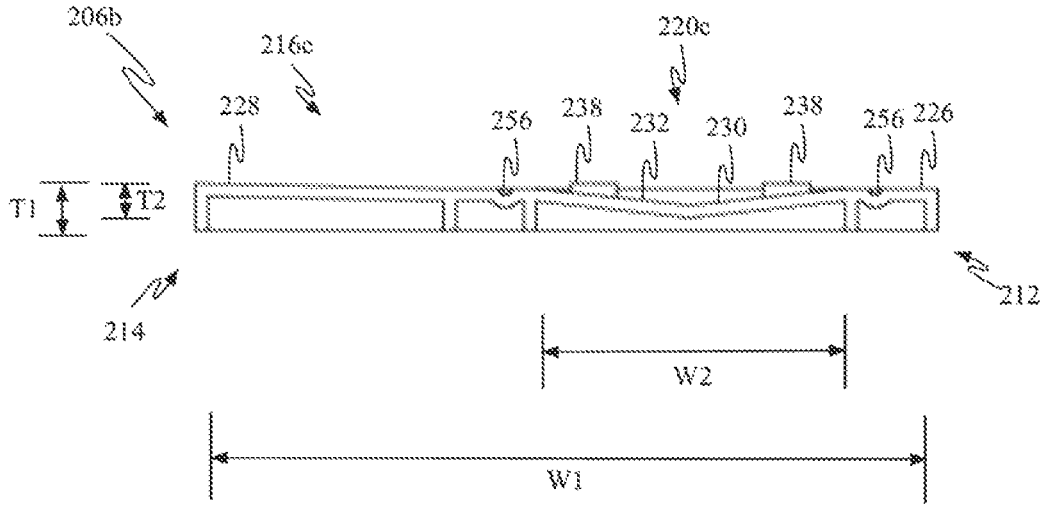
FIG. 12 is a schematic elevational end of the end cap of FIG. 11.

Referring to FIGS. 11 and 12, drain channel 220 may extend from first end 280 of second end cap 206*b* to proximate second end 282 of second end cap 206*b*, for example, defining end cap drain channel 220*c*. Similarly, adhesive channel 256 may extend from first end 280 of second end cap 206*b* to proximate second end 282 of second end cap 206*b*. Thus, as one example, second end cap 206*b* may include two laterally opposed and substantially parallel longitudinal sections of adhesive channels 256, for example, formed in first horizontal surface 226 and second horizontal surface 228, respectively, on either side of end cap drain channel 220*c* and a lateral adhesive channel 256 proximate an end of end cap drain channel 220*c*. End cap top surface 216*c* may also include third horizontal surface 288 extending laterally between first horizontal surface 226 and second horizontal surface 228. Third horizontal surface 288 of second end cap 206*b* may form an end of end cap drain channel 220*c* (e.g., second end cap drain channel). The lateral adhesive channel 256 may be formed in third horizontal surface 288.

Referring to FIGS. 2, 9 and 11, third horizontal surface 288 may allow the construction of floor 100 (e.g., waterproof membrane 108 and floor covering 114) (FIG. 1) to extend up to the end of drain channel 220. Third horizontal surface 288 of each end cap 206 (e.g., first end cap 206*a* and second end cap 206*b*) may form longitudinally opposed ends of (e.g., a closing of) drain channel 220.

While the examples disclosed herein illustrate drain system 200 including only a linear main body 252 (e.g., at least hub 202, at least one extension 204 and at least two end caps 206), additional linear bodies (e.g., at least one additional extension 204) coupled to and/or extending outwardly (e.g., at a right angle) from main body 252 are also contemplated (not explicitly illustrated). For example, drain system 200 may include one or more ninety-degree connectors or one or more T-shaped connectors to interconnect extensions 204 at substantially right angles (not explicitly illustrated). As one example, interconnecting two extensions 204 with a ninety-degree connector may form an L-shaped drain system 200. As another example, interconnecting three extensions 204 with two ninety-degree connectors may form a U-shaped drain system 200. As another example, interconnecting four extensions 204 with four ninety-degree connectors may form a square-shaped drain system 200. As another example, interconnecting three extensions 204 with a T-shaped connector may form a T-shaped drain system 200. Other configurations are also contemplated, for example, as dictated by the type of floor 100 and/or the drainage needs of floor 100. Any angle connectors (e.g., ninety-degree connector and/or T-shaped connector) may similarly include a V-shaped drain channel forming a corner section of drain channel 220 (e.g., in fluid communication with extension drain channel 220*b*) of main body 252, adhesive channels 256, fastening holes 254 and/or height adjusters 238.

Figure 19:
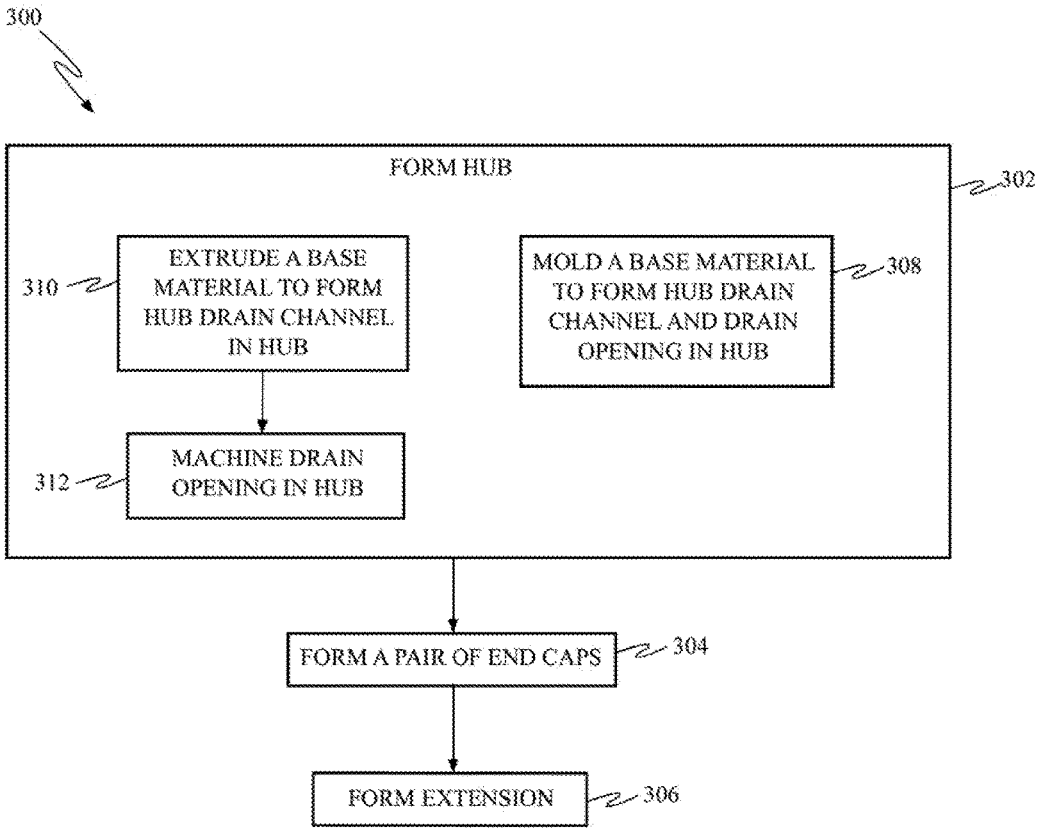
FIG. 19 is a flow diagram of one embodiment of the disclosed method for manufacturing a main body of the disclosed drain system.

Referring to FIG. 19, and with reference to FIGS. 2-4 and 18, one embodiment of method, generally designated 300, for manufacturing main body 252 of drain system 200 is disclosed. Modifications, additions, or omissions may be made to method 300 without departing from the scope of the present disclosure. Method 300 may include more, fewer, or other steps. Additionally, steps may be performed in any suitable order.

Method 300 may begin with the step of forming hub 202, as shown at Block 302. Hub 202 may include a V-shaped hub drain channel 220*a* and drain opening 222. Drain opening 222 may at least partially intersect and be in fluid communication with hub drain channel 220*a*.

Method 300 may further include the step of forming a pair of end caps 206 (e.g., first end cap 206*a* and second end cap 206*b*), as shown at Block 304. Each end cap 206 may include a V-shaped end cap drain channel 220*c*.

Method 300 may further include the step of forming at least one extension 204, as shown at Block 306. Extension 204 may include a V-shaped extension drain channel 220*b*.

In one example, forming hub 202 (Block 302) may include molding a base material (not explicitly illustrated) to form hub drain channel 220*a* (e.g., first sloped surface 230 and second sloped surface 232) and drain opening 222 in hub 202, as shown at Block 308. Molding the base material may also form hub top surface 216*a* (e.g., first horizontal surface 226 and second horizontal surface 228), adhesive channel 256, fastener holes 254 and/or holes for height adjusters 238.

As illustrated in FIGS. 2-4, a molded hub 202 may include a relatively small longitudinal dimension (e.g., length) relative to the overall length L1 of main body 252. In such an example, one or more extensions 204 may be configured to connect to longitudinal ends (e.g., first end 260 or second end 262) of hub 202. Thus, extensions 204 may define a substantial majority of the overall length L1 of main body 252. Further, in such an example, each end cap 206 may be configured to connect to one of an end of hub 202 or an end of extension 204 (e.g., extension 204 may be configured to connect between hub 202 and one of the pair of end caps 206). During construction of floor 100 having drain system 200, hub 202 may be located over and connected to drain 104 (FIG. 1). Extensions 204 and end caps 206 may be connected to and extend from hub 202 to construct main body 252 as dictated by, for example, the final configuration of drain system 200 and/or the construction of floor 100 (FIG. 1).

In another example, forming hub 202 (Block 302) may include extruding a base material to form hub drain channel 220*a* (e.g., first sloped surface 230 and second sloped surface 232) in hub 202, as shown at Block 310. Extruding the base material may also form hub top surface 216*a* (e.g., first horizontal surface 226 and second horizontal surface 228) and/or adhesive channel 256.

Forming hub 202 (Block 302) may further include machining drain opening 222 through hub 202, as shown at Block 312. Fastener holes 254 and/or holes for height adjusters 238 may also be machined through hub 202.

As illustrated in FIG. 18, an extruded hub 202 may include a relatively large longitudinal dimension (e.g., length) relative to the overall length L1 of main body 252. Thus, hub 202 may define a substantial majority of the overall length L1 of main body 252. In such an example, each end cap 206 may be configured to connect to the longitudinally opposed ends (e.g., first end 260 and second end 262) of hub 202. During construction of floor 100 having drain system 200, the longitudinal dimension of hub 202 may be cut to a desired length as dictated by, for example, the final configuration of drain system 200 and/or the construction of floor 100 (FIG. 1). Drain opening 222 may be formed (e.g., machined) through hub 202 at a suitable location as dictated by the location of drain 104 (FIG. 1) to be located over and connected to drain 104.

Forming end caps 206 (Block 304) may include molding a base material to form end cap drain channel 220*c* (e.g., first sloped surface 230 and second sloped surface 232), end cap top surface 216*c* (e.g., first horizontal surface 226, second horizontal surface 228 and third horizontal surface 288), adhesive channel 256, fastener holes 254 and/or holes for height adjusters 238.

Similarly, forming extensions 204 (Block 306) may include molding a base material to form extension drain channel 220*b* (e.g., first sloped surface 230 and second sloped surface 232), extension top surface 216*b* (e.g., first horizontal surface 226 and second horizontal surface 228), adhesive channel 256, fastener holes 254 and/or holes for height adjusters 238.

Other techniques for forming the components of main body 252 (e.g., hub 202, extensions 204 and/or end caps 206) are also contemplated.

Figure 20:
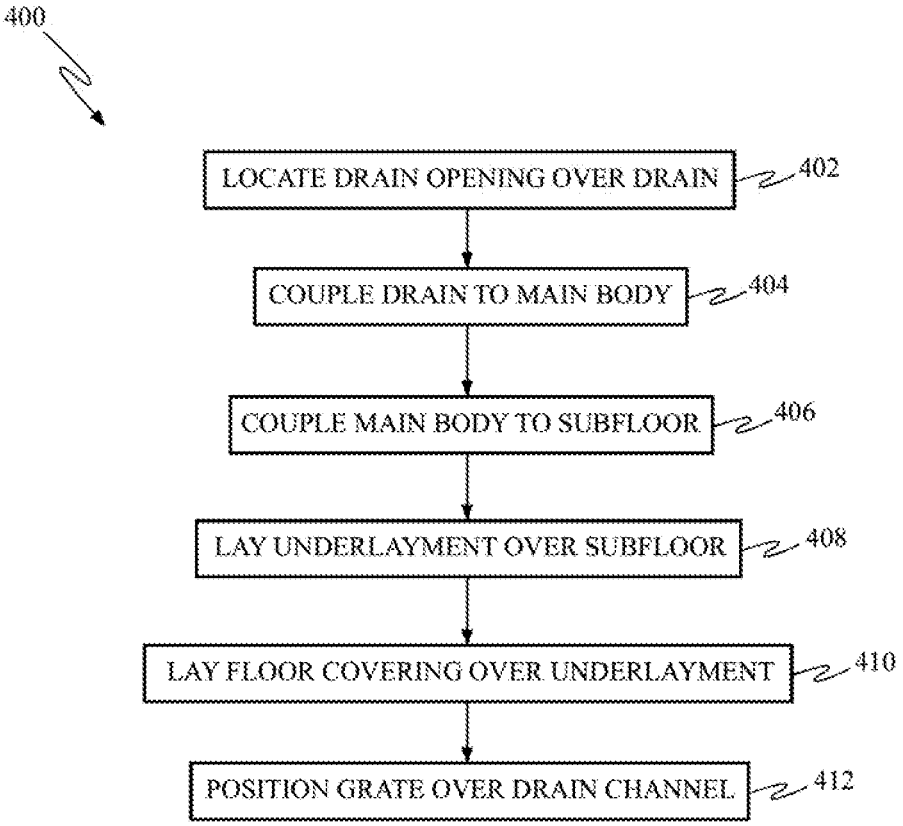
FIG. 20 is a flow diagram of one embodiment of the disclosed method for constructing the disclosed floor with linear drain system.

Referring to FIG. 20, and with reference to FIGS. 1-4 and 18, one embodiment of method, generally designated 400, for constructing floor 100 with a linear drain system 200 is disclosed. Modifications, additions, or omissions may be made to method 400 without departing from the scope of the present disclosure. Method 400 may include more, fewer, or other steps. Additionally, steps may be performed in any suitable order.

Method 400 may begin with the step of locating drain opening 222 of main body 252 over drain 104, as shown at Block 402. As one example, hub 202 including a pre-formed drain opening 222 (e.g., a molded hub 202) may be positioned on subfloor 102 such that at least a portion of drain 104 is disposed within drain opening 222. As another example, hub 202 (e.g., an extruded hub 202) may be positioned on subfloor 102 over drain 104 and drain opening 222 may be formed (e.g., machined) through hub 202 aligned with drain 104.

Method 400 may further include the step of coupling drain 104 to main body 252 (e.g., to hub 202), as shown at Block 404. As one example, flange 286 of hub 202 may engage drain flange 116 of drain 104. Drain fastener 118 may be coupled to drain 104 and tightened to compress flange 286 between drain flange 116 and drain fastener 118.

Method 400 may further include the step of coupling main body 252 of drain system 200 to subfloor 102, as shown at Block 406. As one example, main body 252 may be fastened (e.g., by screws) to subfloor 102. The total number of components of main body 252 (e.g., hub 202, extensions 204 and end caps 206) and the overall length L1 of main body 252 may be dictated by, for example, the type and size of floor 100, the drainage needs of floor 100 and/or the final configuration of drain system 200.

Method 400 may further include the step of laying underlayment 106 over subfloor 102, as shown at Block 408. Underlayment 106 may extend up to (e.g., abut) laterally opposed sides (e.g., first side 212 and second side 214) of main body 252 or of each individual component forming main body 252 (e.g., hub 202, extensions 204 and end caps 206). Similarly, underlayment 106 may extend up to (e.g., abut) longitudinally opposed ends (e.g., first end 208 and second end 210) of main body 252. As described herein above, underlayment 106 may include (e.g., be formed with) a slope directed downwardly toward main body 252.

Optionally, one or more waterproofing membranes 108 may be laid over and coupled (e.g., adhered) to subfloor 102 and/or underlayment 106. Waterproofing membranes 108 may be laid over and coupled to subfloor 102 may extend to sides and ends of main body 252. Waterproofing membranes 108 may be laid over and coupled to underlayment 106 may extend to sides and ends of drain channel 220 formed in top surface 216 of main body 252.

Method 400 may further include the step of laying floor covering 114 (e.g., tile 110) over underlayment 106 (or waterproofing membrane 108), as shown at Block 410. Floor covering 114 may define drain floor surface 112 of floor 100. Floor covering 114 may extend up to (e.g., laid adjacent to) laterally opposed sides of drain channel 220 of main body 252 or of each individual component forming main body 252 (e.g., hub drain channel 220*a*, extension drain channel 220*b* and end cap drain channel 220*c*). Similarly, floor covering 114 may extend up to (e.g., laid adjacent to) longitudinally opposed ends of drain channel 220 of main body 252. As described herein above, underlayment 106 may include (e.g., be formed with) a slope directed downwardly toward main body 252. As described herein above, the resulting drain floor surface 112 formed by floor covering 114 may include a slope matching the slope formed by underlayment 106 to direct water to drain channel 220.

Method 400 may further include the step of positioning grate 224 over drain channel 220, as shown at Block 412. As one example, grate 224 may be supported by a plurality of grate supports 236 coupled to main body 252 within drain channel 220. Each grate support 236 may be coupled to a pair of height adjusters 238. Height adjusters 238 may be adjustably coupled to main body 252 within drain channel 220 (e.g., to first sloped surface 230 and second sloped surface 232) to adjust a vertical position (e.g., height) of grate 224 relative to main body 252. Grate 224 may be positioned to be substantially co-planar with the surface of floor covering 114 to define a portion of drain floor surface 112.

Although various embodiments of the disclosed systems and methods have been shown and described, modifications may occur to those skilled in the art upon reading the specification. The present application includes such modifications and is limited only by the scope of the claims.

What is claimed is:

1. A linear drain system comprising:
a main body comprising:
a first body end and a second body end, opposite said first body end;
a first longitudinal axis that is located at a first lateral center of said main body and that passes through said first body end and said second body end; and
a top surface;
a drain opening formed through said main body; wherein said main body further comprises:
a hub comprising a hub drain channel;
a first end cap comprising a first end cap drain channel, wherein said first end cap coupled to said hub; and
a second end cap comprising a second end cap drain channel, wherein said second end cap coupled to said hub opposite said first end cap;
wherein said hub drain channel, said first end cap drain channel, and said second end cap drain channel define said drain channel, and
wherein said drain opening is formed through said hub and at least partially intersects said hub drain channel; and
a drain channel formed by a portion of said top surface and in fluid communication with said drain opening, said drain channel comprising:
a first channel end, located proximate to said first body end, and a second channel end, located proximate to said second body end; and
a second longitudinal axis that is located at a second lateral center of said drain channel and that passes through said first channel end and said second channel end, and wherein said second longitudinal axis of said drain channel is laterally offset from said first longitudinal axis of said main body.

2. The drain system of claim 1 wherein said main body further comprises a width and a thickness, and wherein said thickness of said main body is no more than fifty percent of said width of said main body.

3. The drain system of claim 2 wherein said drain channel further comprises a second thickness, and wherein said second thickness of said channel is no more than fifty percent of said thickness of said main body.

4. The drain system of claim 1 wherein said main body further comprises an extension comprising an extension drain channel, wherein said extension is coupled between said hub and one of said first end cap or said second end cap, and wherein said hub drain channel, said extension drain channel, said first end cap drain channel, and said second end cap drain channel define said drain channel.

5. The drain system of claim 1 wherein said drain channel further comprises a first channel side, a second channel side, opposite said first channel side, and a width defined between said first channel side and said second channel side, and wherein said width of said drain channel is less than a lateral dimension of said drain opening.

6. The drain system of claim 5 further comprising a cover that configured to be inserted in said drain opening to cover a portion of said drain opening that is not intersected by said drain channel, wherein said cover comprises a cover top surface that is co-planar with said top surface of said main body upon a condition in which said cover is inserted in said drain opening.

7. The drain system of claim 1 further comprising:
a plurality of height adjusters operatively coupled to said main body within said drain channel;
a plurality of grate supports coupled to said plurality of height adjusters; and
a grate supported by said grate supports over said drain channel,
wherein said height adjusters control a position of said grate relative to said main body.

8. The system of claim 1 wherein:
said main body further comprises a first body side and a second body side, laterally opposed to said first body side;
said drain channel further comprises a first channel side, parallel to said first body side, and a second channel side, laterally opposed to said first channel side and parallel to said first body side;
said top surface of said main body comprises:
a first flat surface extending laterally from said first body to said first channel side;
a second flat surface extending laterally from said second body side to said second channel side;
a third flat surface depending downwardly from said first flat surface and extending laterally from said first channel side to said second longitudinal axis; and
a fourth flat surface depending downwardly from said second flat surface and extending laterally from said second channel side to said second longitudinal axis; and
said third flat surface and said fourth flat surface form said drain channel.

9. The system of claim 8 wherein said first channel side of said drain channel passes through a center of said drain opening.

10. The system of claim 1 wherein said drain channel intersects one-half of said drain opening.

11. The system of claim 1 further comprising adhesive channels formed in said top surface of said main body, wherein said adhesive channels extend longitudinally from proximate said first end of said main body to proximate said second end of said main body along laterally opposed sides of said drain channel.

12. The system of claim 11 wherein said adhesive channels completely surround said drain channel and said drain opening.

13. A floor comprising:
a subfloor;
a drain extending at least partially through said subfloor;
a drain system comprising:
a main body comprising:
a first body end and a second body end, opposite said first body end;
a first longitudinal axis that is located at a first lateral center of said main body and that passes through said first body end and said second body end; and
a top surface;
a drain opening formed through said main body, wherein said drain is coupled to said main body within said drain opening; wherein said main body further comprises:
a hub comprising a hub drain channel;
a first end cap comprising a first end cap drain channel, wherein said first end cap coupled to said hub; and
a second end cap comprising a second end cap drain channel, wherein said second end cap coupled to said hub opposite said first end cap;

wherein said hub drain channel, said first end cap drain channel, and said second end cap drain channel define said drain channel, and wherein said drain opening is formed through said hub and at least partially intersects said hub drain channel; and a drain channel formed by a portion of said top surface and in fluid communication with said drain opening, wherein said drain channel comprises:

a first channel end, located proximate to said first body end, and a second channel end, located proximate to said second body end; and a second longitudinal axis that is located at a second lateral center of said drain channel and that passes through said first channel end and said second channel end, and wherein: said second longitudinal axis of said drain channel is laterally offset from said first longitudinal axis of said main body;

an underlayment disposed over said subfloor and extending to said main body; and a floor covering disposed over said underlayment and extending to said drain channel.

14. The floor of claim 13 wherein said main body comprises a thickness, and wherein said thickness of said main body is no greater than a combined thickness of said subfloor and said underlayment.

15. The floor of claim 13 wherein said main body further comprises an extension comprising an extension drain channel, wherein said extension is coupled between said hub and one of said first end cap or said second end cap, and wherein said hub drain channel, said extension drain channel, said first end cap drain channel, and said second end cap drain channel define said drain channel.

16. The floor of claim 13 wherein said drain system further comprises:

a plurality of height adjusters operatively coupled to said main body within said drain channel;

a plurality of grate supports coupled to said plurality of height adjusters; and a grate supported by said grate supports over said drain channel, wherein said height adjusters control a position of said grate relative to said main body to position said grate co-planar with said floor covering.

17. The floor of claim 13 wherein:

said main body further comprises a first body side and a second body side laterally opposed to said first body side;

said drain channel further comprises a first channel side, parallel to said first body side, and a second channel side, laterally opposed to said first channel side and parallel to said first body side;

said top surface of said main body comprises:

a first flat surface extending laterally from said first body side to said first channel side;

a second flat surface extending laterally from said second body side to said second channel side;

a third flat surface depending downwardly from said first flat surface and extending laterally from first channel side to said second longitudinal axis; and a fourth flat surface depending downwardly from said second flat surface and extending laterally from said second channel side to said second longitudinal axis; and said third flat surface and said fourth flat surface form said drain channel.

18. The floor of claim 17 wherein:

said drain channel further comprises a second thickness and said second thickness of said channel is no more than fifty percent of said thickness of said main body; and said first channel side of said drain channel passes through a center of said drain opening.

* * * * *